US008434794B2

(12) United States Patent
Sijmons et al.

(10) Patent No.: US 8,434,794 B2
(45) Date of Patent: May 7, 2013

(54) THREE STAGE MULTI-POINT CLOSURE SYSTEM FOR LUGGAGE

(75) Inventors: Erik Sijmons, Oudenaarde (BE); Willy Van Hoye, Zwijnaarde (BE); Rudi Boudry, Ghent (BE); Tobias Ackerman, Wuppertal (DE)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 907 days.

(21) Appl. No.: 11/574,448

(22) PCT Filed: Apr. 28, 2005

(86) PCT No.: PCT/US2005/015553

§ 371 (c)(1),
(2), (4) Date: Nov. 18, 2008

(87) PCT Pub. No.: WO2006/025877

PCT Pub. Date: Mar. 9, 2006

(65) Prior Publication Data

US 2009/0071780 A1 Mar. 19, 2009

Related U.S. Application Data

(60) Provisional application No. 60/605,804, filed on Aug. 31, 2004.

(51) Int. Cl.
*E05C 9/16* (2006.01)
*E05C 19/10* (2006.01)

(52) U.S. Cl.
USPC ..... 292/26; 292/8; 292/30; 292/DIG. 11; 292/DIG. 42

(58) Field of Classification Search ..... 70/69–76, 70/79–84; 190/100, 101, 118–122; 292/28, 292/32, 38, 22, DIG. 31, 4–8, 24, 26, 30, 292/292/34–36, 41, 57–62, 63, 64, 66, 69, 292/DIG. 11, DIG. 42, DIG. 50, 332, 335
See application file for complete search history.

(56) References Cited

U.S. PATENT DOCUMENTS 222,359 A * 12/1879 Luce ..... 70/70
1,072,981 A * 9/1913 Partmann ..... 150/110

(Continued)

FOREIGN PATENT DOCUMENTS

EP 1669527 6/2006
GB 246089 1/1926

(Continued)

OTHER PUBLICATIONS

International Search Report and Written Opinion dated Oct. 28, 2005, PCT/US2005/15553, 6 pages.

*Primary Examiner* — Carlos Lugo
*Assistant Examiner* — Alyson M Merlino
(74) *Attorney, Agent, or Firm* — Dorsey & Whitney LLP

(57) ABSTRACT

Disclosed is a method and system for providing several stages of closure of a luggage case (2), including an open stage, a pre-close stage in which one or more latching mechanisms are engaged, and a secure stage in which a drawing action pulls both shells of the luggage case (2) further together. Also disclosed is a method and system for automatically ensuring proper latching of the multiple latching mechanisms around the perimeter of a luggage case (2). The latching mechanisms may be aligned by use of a single operative mechanism (16). The present invention comprises a low-friction, durable system. The present invention ensures security of a user's belongings by providing the extra measurement of closure. The user enjoys a single operative mechanism (16), and needs to exert only a minimal amount of pressure to latch the case (2), thanks to a clever design of the single operative mechanism (16). The user needs not worry about their suitcase (2) popping open due to a failed latching mechanism.

19 Claims, 28 Drawing Sheets

U.S. PATENT DOCUMENTS

| | | | | | |
|---|---|---|---|---|---|
| 1,112,706 | A | * | 10/1914 | Koch | 70/70 |
| 1,827,060 | A | * | 10/1931 | Albert | 70/72 |
| 1,941,459 | A | * | 1/1934 | Bock | 292/142 |
| 2,754,142 | A | * | 7/1956 | Baker, Jr. | 292/6 |
| 2,778,089 | A | * | 1/1957 | Woltering | 27/17 |
| 2,787,487 | A | * | 4/1957 | Baker, Jr. | 292/4 |
| 2,864,640 | A | * | 12/1958 | Mattinson | 292/335 |
| 2,950,793 | A | * | 8/1960 | Axtell | 190/115 |
| 3,054,631 | A | * | 9/1962 | Wilkirson | 292/66 |
| 3,135,105 | A | * | 6/1964 | Brody | 70/71 |
| 3,342,516 | A | * | 9/1967 | Morand | 292/6 |
| 3,393,539 | A | * | 7/1968 | Gehrie | 70/71 |
| 3,400,562 | A | * | 9/1968 | Bloss | 70/70 |
| 3,555,860 | A | * | 1/1971 | Atkinson | 70/312 |
| 3,586,360 | A | * | 6/1971 | Perrotta | 292/26 |
| 3,899,151 | A | * | 8/1975 | Kobrehel | 248/429 |
| 3,987,876 | A | * | 10/1976 | Foults | 190/120 |
| 4,020,930 | A | | 5/1977 | Weber | |
| 4,363,226 | A | * | 12/1982 | Remington et al. | 70/70 |
| 4,365,490 | A | * | 12/1982 | Manzoni | 70/70 |
| 4,366,685 | A | * | 1/1983 | Remington | 70/70 |
| 4,395,892 | A | * | 8/1983 | Remington | 70/312 |
| 4,416,126 | A | * | 11/1983 | Remington | 70/71 |
| 4,677,832 | A | * | 7/1987 | Remington | 70/67 |
| 4,762,346 | A | * | 8/1988 | King | 292/38 |
| 4,779,907 | A | * | 10/1988 | Yu | 292/33 |
| 4,852,371 | A | | 8/1989 | Pfeiffer | |
| 5,027,967 | A | | 7/1991 | Tellas | |
| 5,203,449 | A | | 4/1993 | Bonardi | |
| 5,943,886 | A | | 8/1999 | Chiang | |
| 6,540,268 | B2 | * | 4/2003 | Pauser | 292/48 |
| 2004/0227349 | A1 | * | 11/2004 | Denys | 292/26 |

FOREIGN PATENT DOCUMENTS

| | | |
|---|---|---|
| JP | 7224565 | 8/1995 |
| JP | 3027842 | 8/1996 |
| JP | 2001512328 | 8/2001 |
| JP | 2004068394 | 3/2004 |
| WO | WO 92/08386 | 5/1992 |

* cited by examiner

THREE STAGE MULTI-POINT CLOSURE SYSTEM FOR LUGGAGE

This application is a U.S. national application under 35 USC 371 of International application Serial No. PC/US2005/15553, filed Apr. 28, 2005, which claims priority from U.S. Provisional Patent Application No. 60/605,804 filed Aug. 31, 2004.

BACKGROUND OF THE INVENTION

This invention relates to a latching system for luggage. More particularly, this invention relates to a three-stage latching mechanism for opening a suitcase or the like, pre-closing a suitcase, and securing a suitcase using multiple, spaced latching mechanisms operated from a single location on the suitcase.

Currently, many different forms of latching mechanisms for luggage, including hard sided luggage cases, are available on the market. For example, typical luggage cases include latches that may comprise claw bolts, sliding bolts, latch hooks that are operated by buttons, levers, continuous slide closures, known as zippers, and other mechanisms. At least one prior luggage latching system had two latching mechanisms that were remotely operated by a single operator, preferably located on the front side of the suitcase opposite the hinged side. A single operator simplifies the tasks of closing and opening a suitcase. Having several such latching mechanisms provides a secure closure on suitcases ranging from rigid clamshell types of bodies to light weight structures. As such, the term "luggage" herein is meant to include all types of storage and/or transport vessels including large storage containers such as molded plastic storage and shipping boxes for linens and the like, briefcases, soft luggage, hybrid luggage, computer bags, messenger bags, backpacks, etc.

Single-operator systems have the potential to be user friendly, and multiple latching locations provide additional security. However, currently there is no provision for ensuring that each remotely operated latching mechanism has experienced a successful engagement. In this way, a currently available suitcase having such multiple location latching mechanisms may seem closed but in fact not be securely latched in remotely operated latch location(s). Once the suitcase has been closed, it is difficult to discern whether or not the latching mechanisms have been properly engaged. One blocked latch may disrupt the entire latching system and permit the suitcase to pop open. Thus, a user may unknowingly attempt to lock their suitcase without proper latch engagement and risk losing their valuables should the suitcase indeed open.

Furthermore, some existing single operator multi-point latching mechanisms require a substantial amount of force to close and lock the suitcase. Such systems may undergo a high amount of friction between components. Latch misalignment occurs frequently making currently available single remote operator multi-point latching systems unreliable and difficult to operate.

A need therefore exists for a multiple latching system, operated and locked by a single operative mechanism that provides more than the two traditional "opened" and "closed" stages of latching. It would be beneficial to have a "pre-close" stage in which proper latching of each latching mechanism is initially ensured. It would be of further benefit to achieve multiple stages of latching, including such a pre-close stage, automatically at each of the multiple latching mechanisms.

A need also exists for further ensuring the secure closure of a suitcase by performing an additional drawing action between the top and bottom portions of the suitcase. A need further exists for a low-friction means of achieving automatic latch alignment to provide longevity of the parts and mechanisms.

BRIEF SUMMARY OF THE INVENTION

These goals have been achieved by the present invention, which provides a system that creates three stages of latching for luggage cases. The first stage comprises a completely open condition, in which the suitcase portions may be separated from one another, the luggage case ready to be packed, and with the latches not at all engaged. The second stage is called the pre-close stage, in which the suitcase has been closed, and the respective mating latching mechanisms are properly aligned and loosely engaged. The third stage of latching includes a secure position in which all latching mechanisms are fully engaged, and the mating top and bottom portions of the luggage case are drawn further together. In addition, the three stages of operation can be achieved by use of a single operator. Furthermore, the pre-close stage may be achieved automatically. Automatic alignment of the latching mechanisms is achieved by a system that includes an operative rotational lever that dictates lateral movement of a track located within and sliding along a frame of the luggage case. The track incorporates mating mechanisms that laterally move in order to automatically align with corresponding mating latching mechanisms in the opposite portion of the luggage case.

Accordingly, each latching mechanism includes a paired catch plate and hook, either one or both mounted to be moved, along with at least one additional latch mechanism, by a single operator. The single operator places the paired catch plate and hook in the open position, the pre-close position, or the secure position. In the preferred embodiment of the invention, each hook is attached to one of either the top or bottom portion of the case, (preferably to the frame), to mate with the corresponding component by protruding into the opposite case portion (or frame). Of course, the latching mechanisms need not be limited to a paired catch plate and hook, but rather could comprise any type of mating system as is commonly used in the art. Examples include systems of paired hooks moved into and out of mutual engagement by a single, conveniently located operator.

To achieve the three latching stages, each catch plate slides laterally within a channel formed by the corresponding frame. The catch plate is movably mounted to the inside surface of a carriage that may freely slide within the channel. The catch plate in turn is movably mounted on the carriage by cam followers that engage cams on the carriage. The carriage moves laterally within the channel, its lateral movement controlled by the single operator. The carriage may be comprised of a rigid material. As such, in order for the three-stage multi-point closure system to move around the corners of the frame, the carriage is connected to a flexible link. The flexible link is preferably constructed of polymer or any other flexible yet durable material. The multi-point closure system may comprise a series of several latching mechanisms and carriages. The flexible link connects each carriage so that a user may adjust the carriage position all along the length of the frame in order to align catch plates with hooks for open, pre-close, and secure stages.

A spring connects the carriage to the catch plate. The spring biases the catch plate in the pre-close position. In the pre-close position, the cam follower rides uppermost in the cam thus holding the catch plate towards the corresponding hook mounted to the other frame. When the suitcase is in the secure condition, the cam follower rides downward towards the lowest section of the cam, pulling in on the catch plate and the now captured hook and thus creating a secure closure.

The specific features and other aspects of the invention, as well as its various benefits, will be made clear in the detailed description, which follows.

DETAILED DESCRIPTION

Figure 1:
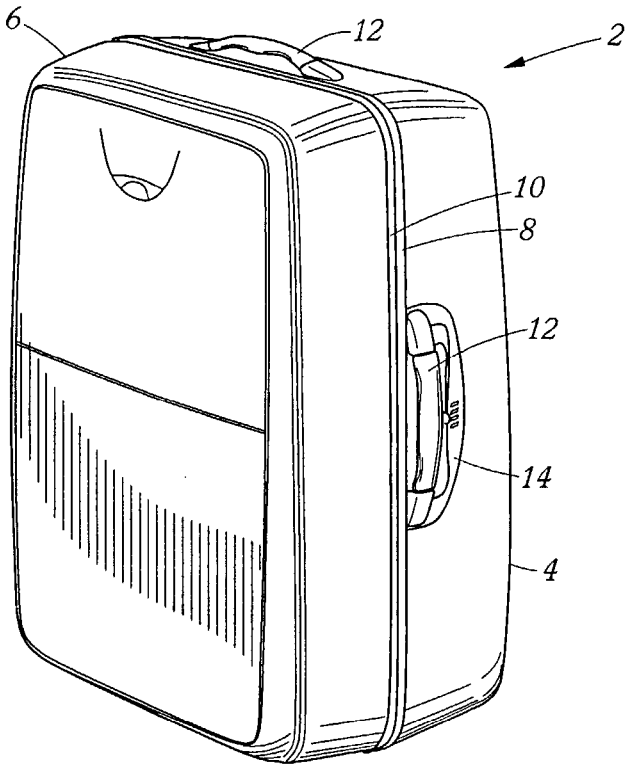
FIGS. 1 and 2 are various views of the luggage case of the present invention.

Referring to FIG. 1, a luggage case 2 includes a three-stage multi-point closure system (MPC) 14 embodying the invention. Luggage case 2 comprises a base shell 4 and a lid shell 6, hinged to the base shell by hinges (not shown) along the edge opposite from that shown. The shells preferably are molded of plastic, either by injection molding or vacuum forming. Between the shells 4 and 6 are the visible portions of the lips of base shell frame 8 and lid shell frame 10. Also shown in FIG. 1 are carry handles 12.

Figure 2:
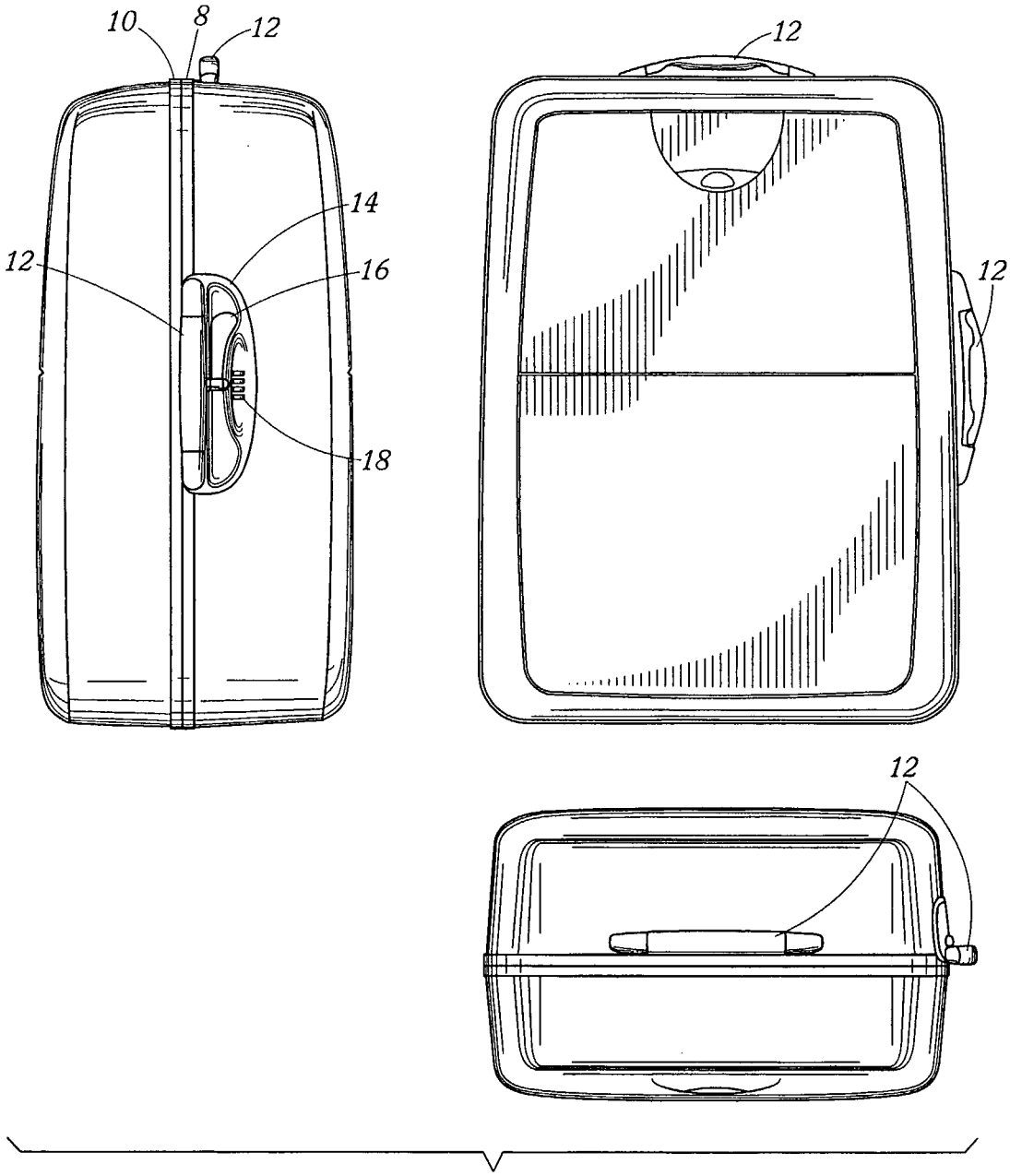

As shown in FIG. 2, MPC 14 comprises an operative lever 16. MPC 14 may also comprise a combination lock of conventional construction, the permutation wheels of which are shown at 18. Operative lever 16 is styled ergonomically so that lever 16 is easy to both grasp and manipulate. Of course shape, dimension and construction of operative lever 16 may vary according to the esthetics and use of the present invention. Wheels and an extending tow handle (not shown) may form part the overall construction of the case 2, depending on the size of the luggage case.

Figure 3B:
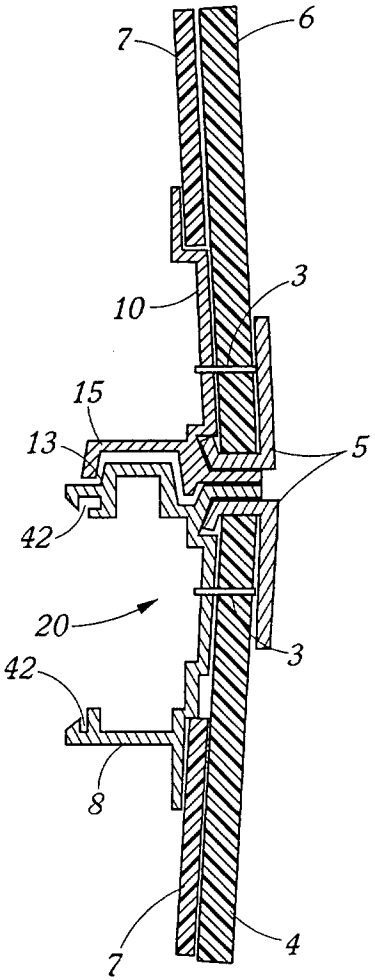
FIG. 3B represents a cross section of the upper and lower frames of the luggage case being affixed to the luggage case by use of staples and strips.
Figure 3A:
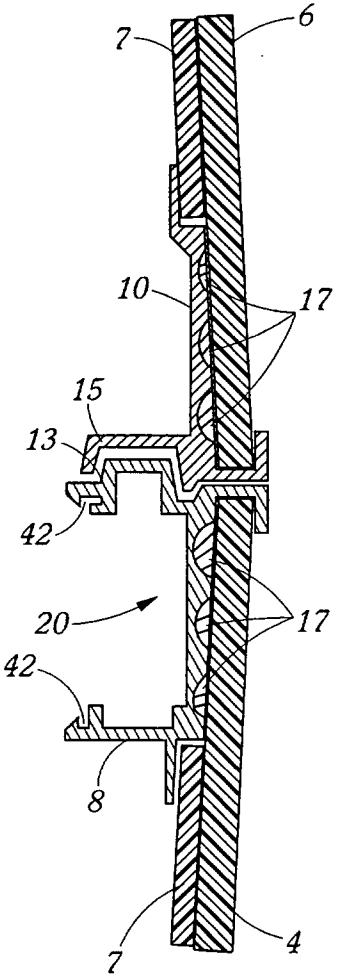
FIG. 3A represents a cross section of the upper and lower frames of the luggage case being affixed to the luggage case by glue.

Referring to FIGS. 3A and 3B, a lid frame 10 mates with a base frame 8. Frames 8 and 10 may be manufactured of extruded aluminum or magnesium or may be integrally formed from the same polymer material from which the shells are molded. Frames 8 and 10 are preferably constructed of, or at least selected surfaces are coated with, a material that has a low coefficient of friction, as is the case with all applicable parts of the MPC 14, to create a low-friction and therefore durable system. Of course, frames 10 and 8 may be constructed of any material suitable for the use of the present invention and could comprise varying cross sections, dimensions, and configurations relative to each other, and means of attachment to case 2. As can be seen in FIGS. 3A and 3B, base frame 8 includes a channel 20 along which the portions of the MPC 14 may freely slide. Base frame 8 also includes a base frame groove 42 to accommodate cover 40 as will be detailed. As shown in FIG. 3A, lid frame 10 and base frame 8 may be attached to lid shell 6 and base shell 4 respectively by glue 17 which has flowed into the extruded channels formed for the purpose of bonding the frames to the edge portions of the respective shells. Glue 17 may comprise any glue suitable for bonding frames of metal, plastic, or any other construction to suitcase shells of metal, plastic or fabric construction. Alternately, frames 10 and 8 may be attached to shells 6 and 4 by staples 3 and strips 5 as shown in FIG. 3B. In this embodiment of the present invention, staples are used to affix the frames to their corresponding shells. A strip 5 of material is then run along the length of the outer surface of the shells to cover the staples 3. The material comprising strip 5 may be of rigid or flexible composition. Flexible strips 5 made of any rubbery or elastic composition such as TPE (thermoplastic elastomer), extruded to have the cross-sectional shape as shown, can flex out of the way during stapling, then spring back to cover the exposed portions of the staples. Of course, any means may be used to secure frames 8 and 10 to shells 4 and 6 including screws, bolts, rivets, and so on. Alternatively, frames 8 and 10 may be machined or molded directly into shells 4 and 6.

Both embodiments include the possibility of a lining 7, usually of textile material, extending to cover the interior surfaces of each shell. The raw edge of the lining 7 is neatly received in a groove extruded for that purpose in each of the frames 8 and 10.

The overall bending moments of frame 8 and frame 10 are closely matched. Base frame 8 includes a protruding edge 13 that extends along its length. This edge 13 has an overall trapezoidal cross-section. The lid frame 10 has a correspondingly shaped groove 15 along its downwardly facing side. When the lid and base shells are closed, the edge 13 is intimately engaged in the groove 15 along substantially the entire periphery of the closed shells. This intimate engagement of base and lid frames is also achieved by locking the luggage case 2 in more than one location. When the disclosed system 14 is in the "secure" condition, this intimate engagement is enhanced via the drawing action such that the upper and lower frames act more or less as a single structural member. In this way, the stiffness of the frames is increased considerably. Thus, if the disclosed case 2 is abused and permanently distorted, the upper and lower frames, and thus the latching mechanisms, will most likely remain properly aligned and fully functional.

Figure 4:
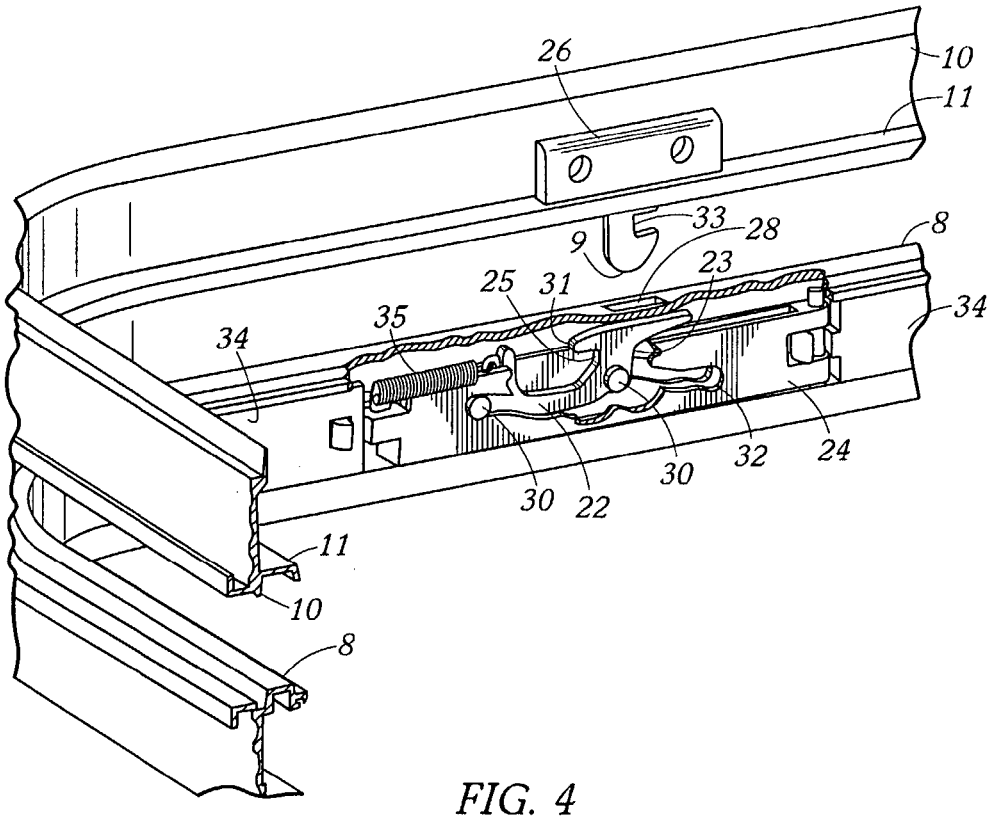
FIG. 4 shows a partial view, from the inside of the luggage case, of the upper and lower frames in the open position.
Figure 4A:
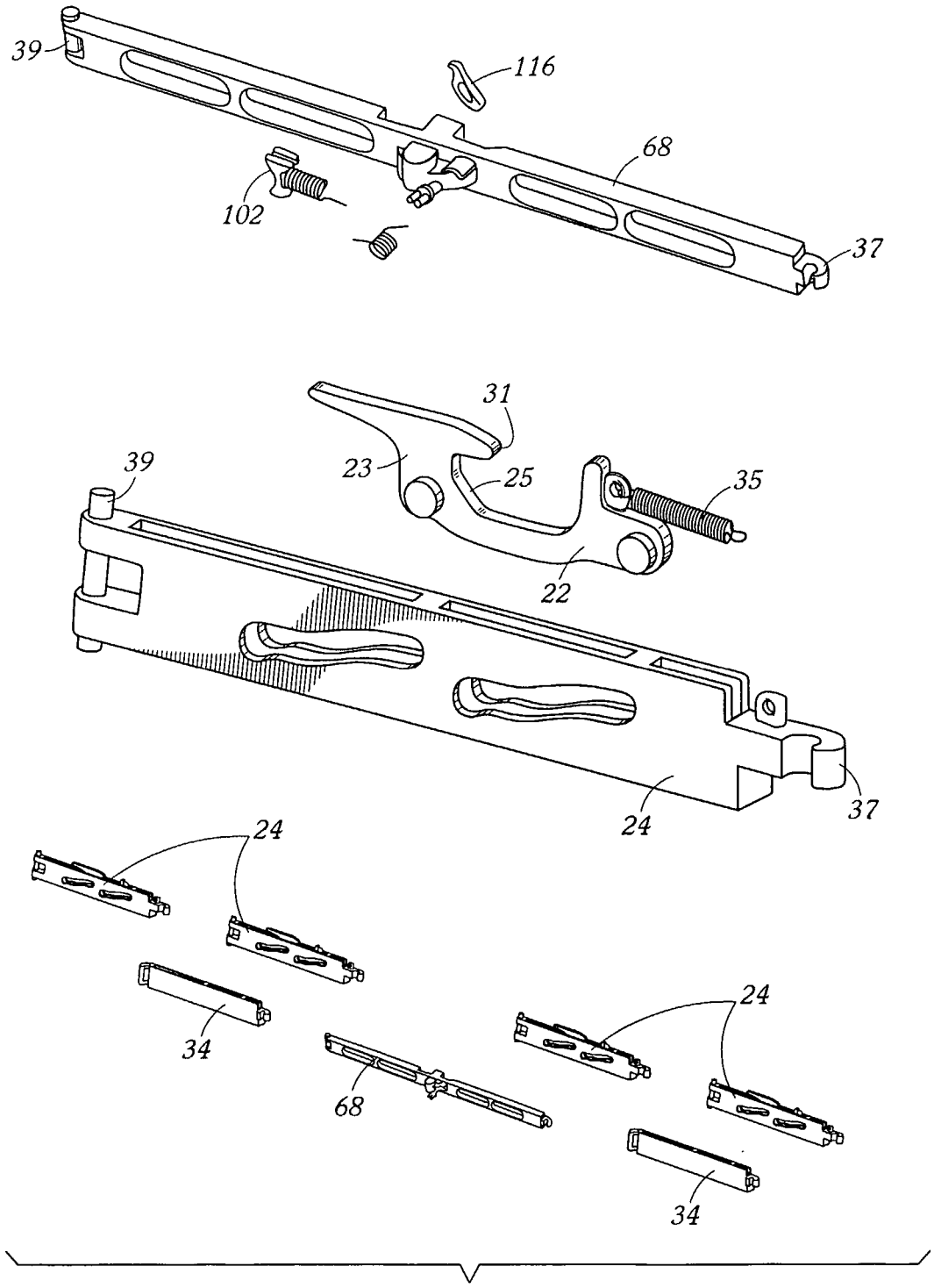
FIGS. 4A through 4D comprise exploded views of portions and subassemblies of the inventive latching system.
Figure 4B:
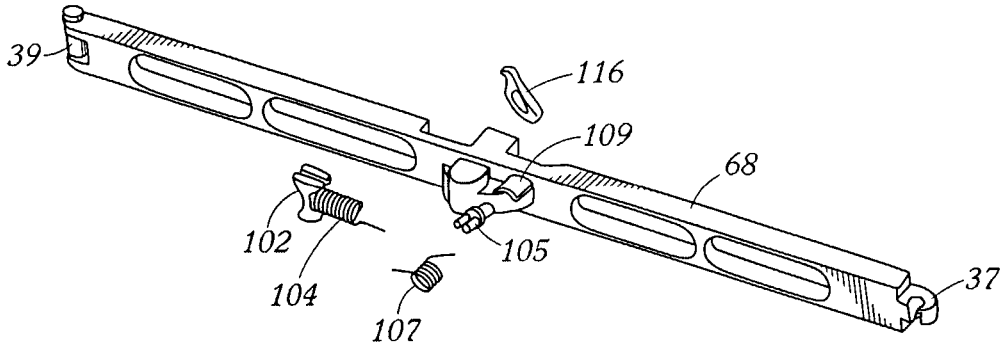
Figure 4C:
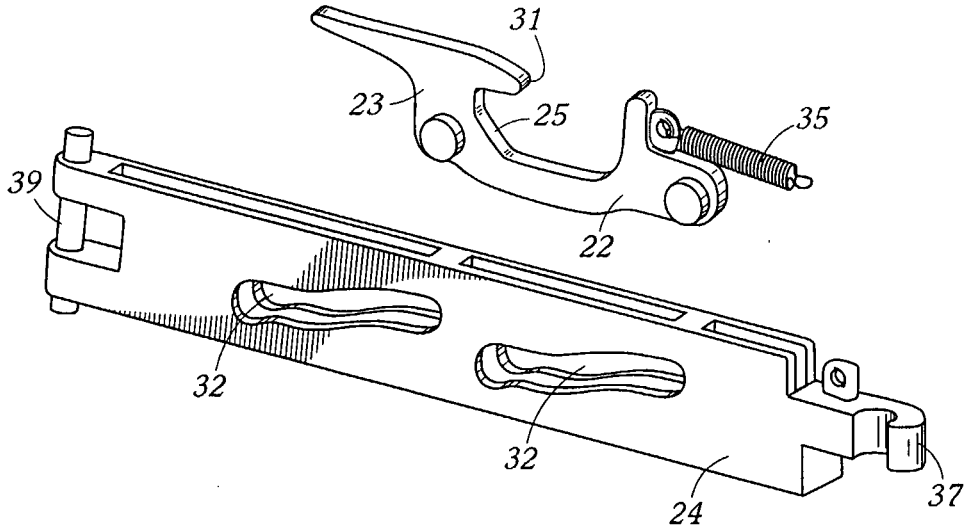

FIG. 4 is a partial perspective view of a pair of luggage case frames that illustrates one of the latch mechanisms in its place along these frames. Base frame 8 and lid frame 10 are shown without their attached lid and base shells. Not shown is an aesthetic cover 40. Base frame 8 and lid frame 10 are currently in the open position. That is, a hook 26 and a catch plate 22 are disengaged. Hook 26 is fixedly mounted to an inner channel 11 of lid frame 10 within a milled slot through the inner channel 11. Hook 26 comprises a solid, sturdy material and has a tapered, rounded head 9. Hook 26 may be engaged with a catch plate 22 that is in turn attached to a movable carriage 24. As shown in FIGS. 4, 4A and 4C, catch plate 22 may also comprise a solid material with an upright portion 23 having a cavity 25 machined therein for engagement of hook 26. Note that catch plate 22 also consists of horizontal portion 31. Horizontal portion 31 catches a receiving portion 33 of hook 26. When horizontal portion 31 rapidly meets with receiving portion 33, a perceptible "click" sound can be heard by the user. Carriage 24 may be constructed of a material having a low coefficient of friction and may be of rigid construction to provide stability to the design. Carriage 24 is attached fixedly to at least one flexible link 34. Of course, variations to the components of the slider mechanism could be contemplated. For example, the catch plate 22/carriage 24 design could be replaced with some other mechanism for providing the requisite lateral movement in response to the operator, and perpendicular motion in response to engaging the corresponding hook 26, and the individual components of the slider mechanism of the present embodiment could vary in type, design and dimension. Flexible link 34 is comprised of a low-friction material and, as such, allows the MPC 14 to freely slide along the straight portions and around the corners of base frame 8. A spring 35 is fixedly attached by one end to catch plate 22 and by the other end to carriage 24. Spring 35 biases the catch plate 22 to the left as shown in FIG. 4 in the open position and in the pre-close position, depending on the position of operative lever 16. That is, when the MPC 14 is in the open position and the pre-close positions, spring 35 is in a relatively minimally tensioned, natural resting state. When the MPC 14 shifts into the secure stage, spring 35 is fully extended.

Catch plate 22 also includes cam followers 30. Cam followers are designed to follow cam slots 32 which are machined in the form of downwardly sloped slots in carriage 24. When the suitcase 2 is in the open position, cam followers 30 rest in the upper portions of cam slots 32, held there by the spring 35. At the same time, hook 26 is positioned relative to an opening 28. Opening 28 is a hole machined within the upper surface of base frame 8 to receive hook 26. When the suitcase lid 6 is closed, hook 26 pushes on the upper surface of catch plate 22 and moves it against the bias force of spring 35. When the hook moves past this upper surface, the spring 35 pulls the catch plate back to the pre-close position and the hook 26 becomes loosely engaged with catch plate 22. This state of loose engagement between hooks 26 and catch plates 22 is referred to as the pre-close stage. Of course, it should be understood by one of ordinary skill in the art that hook 26 and catch plate 22 may be oppositely mounted. That is, hook 26 may be mounted on base frame 8 and catch plate 22 may be mounted on lid frame 10 to achieve the same multi-point closure result. Correspondingly, the MPC 14 may also be mounted on lid frame 10. Lid frame 10 and base frame 8 are shown in greater detail in FIG. 5.

Figure 4D:
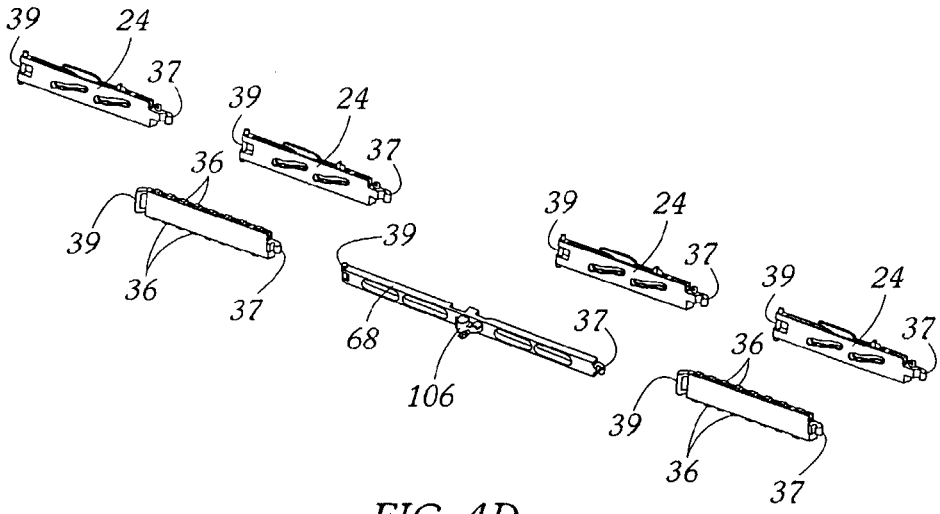
Figure 5:
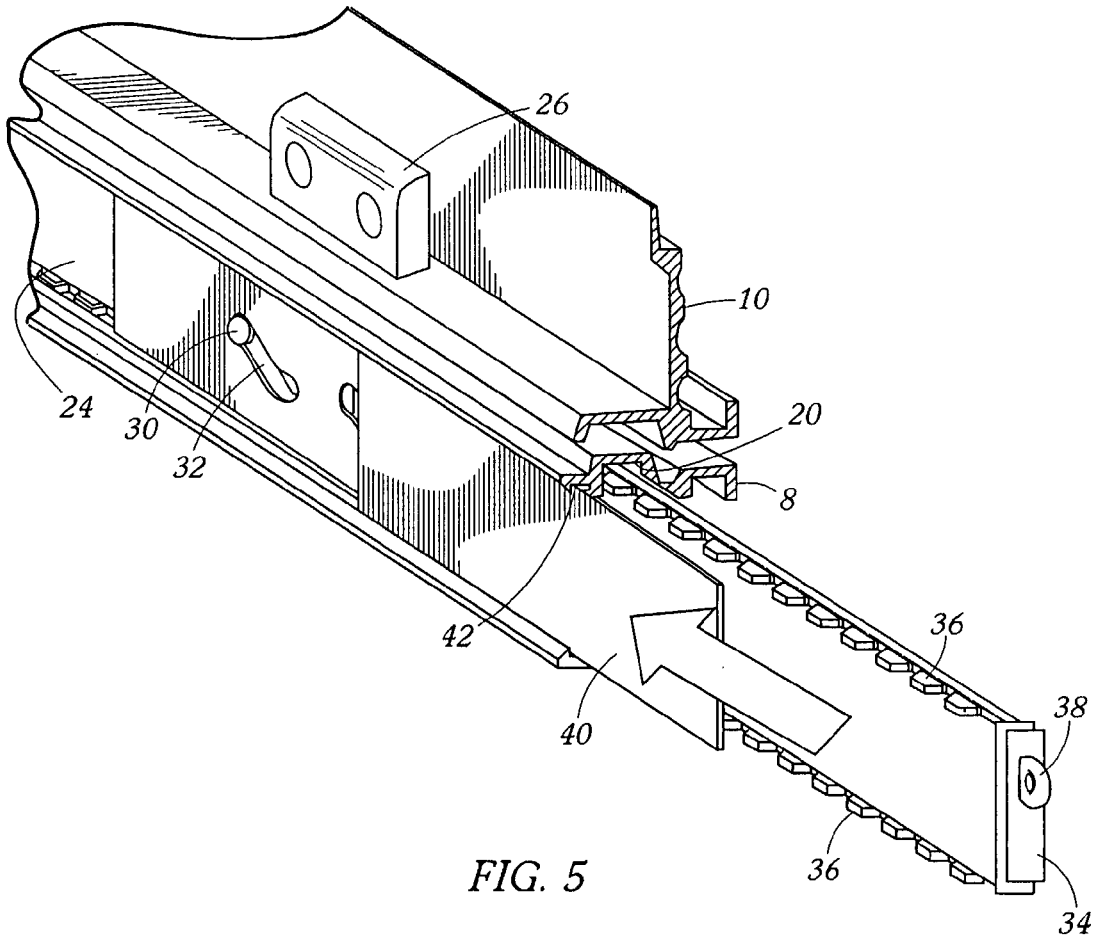
FIG. 5 is a perspective view from the inside of the luggage case of knobs located on a flexible link as well as an aesthetic cover.
Figure 5A:
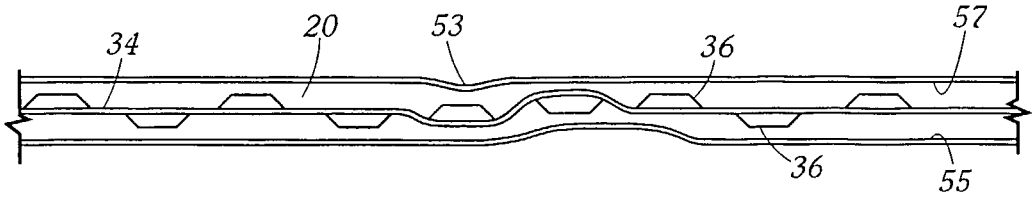
FIGS. 5A and 5B are a top view of the knobs of the flexible link shown in FIG. 5.
Figure 5B:
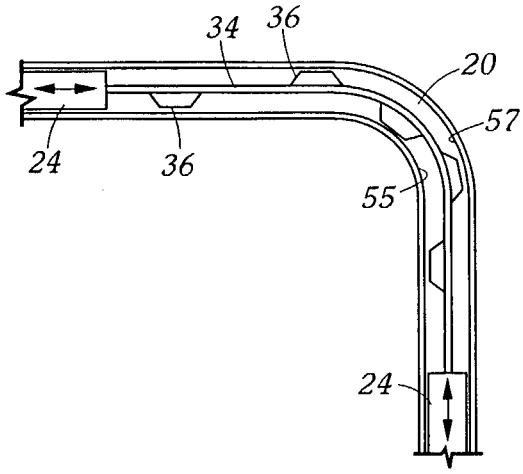
Figure 5C:
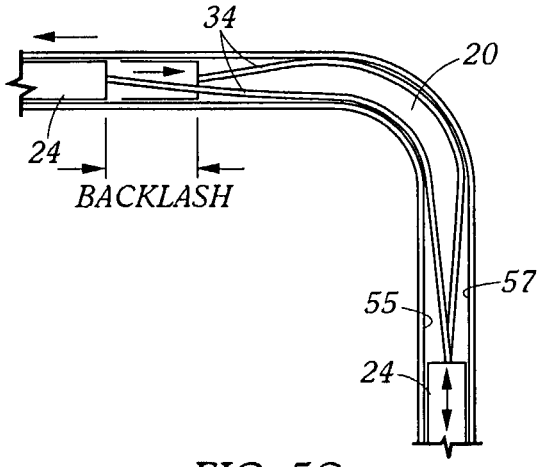
FIG. 5C is a top view the flexible link shown in FIG. 5 without the knobs.

An inventive feature of MPC 14 is a method for ensuring uninterrupted, smooth movement of flexible link 34. Referring to FIG. 5, flexible link 34 freely slides in both a forward and backward lateral direction within channel 20 of base frame 8. Therefore, flexible link 34 undergoes both pull and push forces. It is important to maintain an adequate level of stiffness in flexible link 34 so that flexible link 34 can avoid backlash, as indicated on FIG. 5C, and therefore be reliably moved and positioned for engagement of hook 26 and catch plate 22. It is also important to avoid making flexible link 34 too stiff, because link 34 must retain enough flexibility to easily traverse the corners of luggage case 2. As such, knobs 36 may be added to flexible link 34. As shown in FIGS. 5A and 5B, knobs 36 are of a trapezoidal cross-section and can be molded into the top and bottom portions of flexible link 34 all along each section of flexible link 34. Of course, knobs 36 could comprise any shape, size, or composition suitable to the implementation of the present invention. As shown in FIGS. 5A and 4D, knobs 36 are staggered on opposite surfaces of flexible link 34. The purpose of knobs 36 is to provide a sufficient level of stiffness to flexible link 34 such that link 34 can resist deformation due to push/pull forces while remaining flexible enough to easily negotiate the corners of luggage case 2. Thus, in the event of a dent 53 in base frame 8, (or lid frame 10, depending upon the configuration of the MPC 14), flexible link 34 remains stiff enough to bypass the dent 53, continue to meander through the channel 20, and allow normal operation of the MPC 14 to be maintained. In addition, knobs 36 reduce friction between flexible link 34 and channel 20. Another function of knobs 36 is to help retain flexible link 34 in the middle portion of channel 20. Referring to FIG. 5C, without knobs 36, it is possible that lost or wasted motion between a pinion gear 48 (located on operative lever 16) and a rack 68 causes backlash or "flex" of flexible link 34. As a result, flexible link 34 may move about within channel 20, and may hug either the inside surface 55 of channel 20 or the outside surface 57 of channel 20. This "hugging" may result in the miscorrelation of the catch plates 22 and the position of the operative lever 16 and/or the positions of the other catch plates 22 in the MPC 14, as illustrated in FIG. 5B. The knobs increase accuracy in the alignment of hooks 26 and catch plates 22. It should be understood by one of ordinary skill in the art that knobs 36 can be implemented in all embodiments of the present invention.

Figure 8:
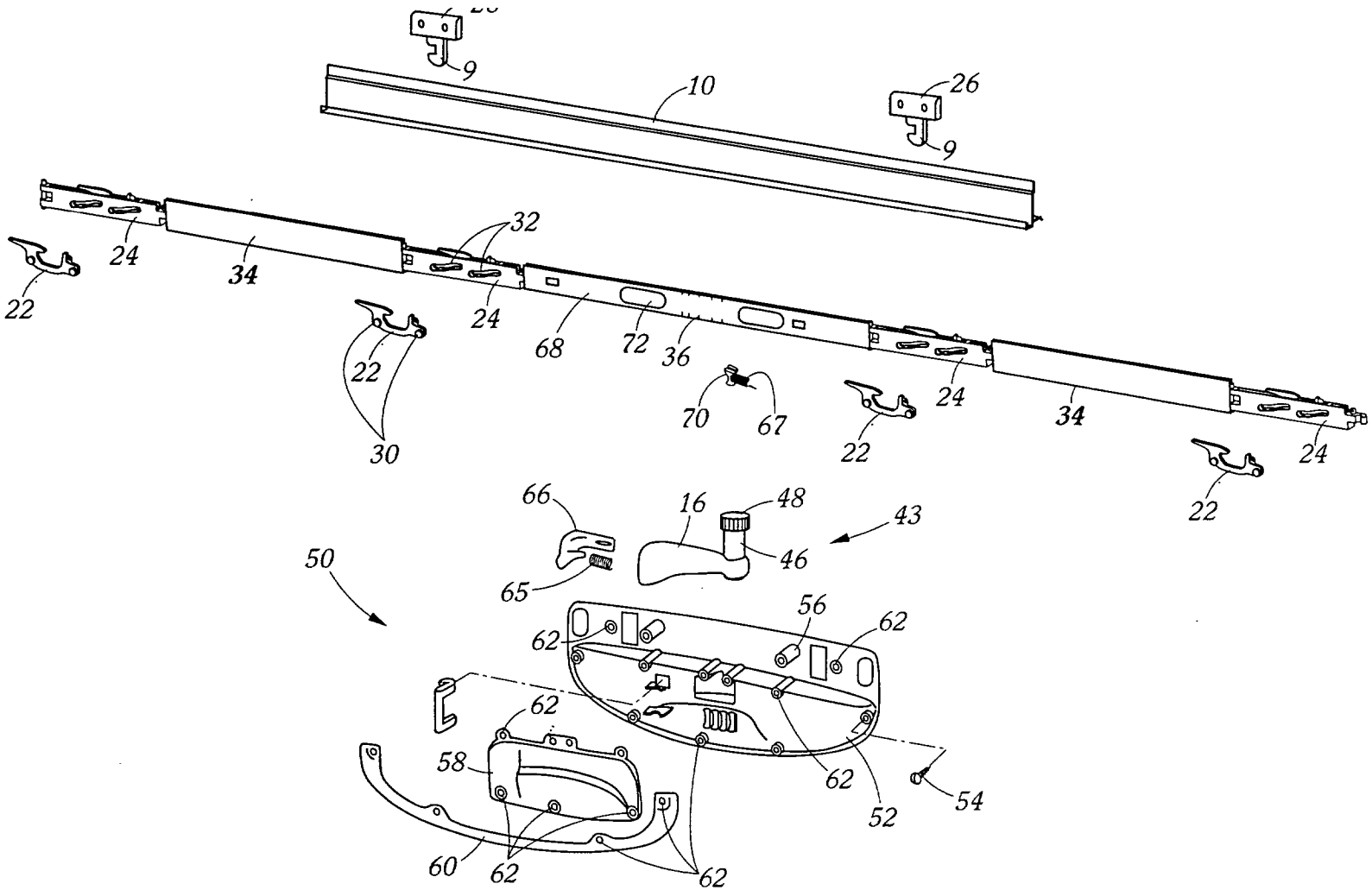
FIGS. 8, 9, 10A and 10B are an exploded view showing the major portion of the invention as viewed from the inside of the luggage case.

As shown in FIG. 8, a knob 36 could serve a dual purpose. Knobs 36 could also be incorporated onto flexible link 34 to engage a pinion gear 48, that is located on the operative lever 16. Knobs 36 on link 34 may help to achieve lateral movement of flexible link 34. Alternatively, teeth can be used to engage the pinion gear 48 of operative lever 16. Such teeth could be mounted onto rack 68 or molded into rack 68, and could run along the full height of rack 68 or just along a top and bottom portion of rack 68 so long as the teeth are of an adequate size to grasp the corresponding pinion gear 48. It should be understood by one of ordinary skill in the art that flexible link 34 may be laterally moved by mechanisms other than pinion gear 48 and knobs 36 or teeth. Such mechanisms will be discussed in greater detail with regard to the description of FIGS. 13 through 30. As stated previously, with regard to the description of FIG. 4, carriage 24 is fixably attached to flexible link 34. As shown in FIG. 5, the suitcase is in the pre-close position. Hook 26 is loosely engaged with catch plate 22 (not shown). Flexible link 34 includes lug 38 that is attached to carriage 24. Of course, flexible link 34 and carriage 24 may be linked by any other mechanism, including pins, staples, and so on. Also shown in FIG. 5 is a cover 40 which may be slidably moved within base frame groove 42 to conceal the inner workings of the MPC 14 from the user's view and thus provide a pleasing appearance to the user. Cover 40 may comprise a flexible or rigid material that is of such thickness so as to fit snugly within base frame groove 42.

Figure 6:
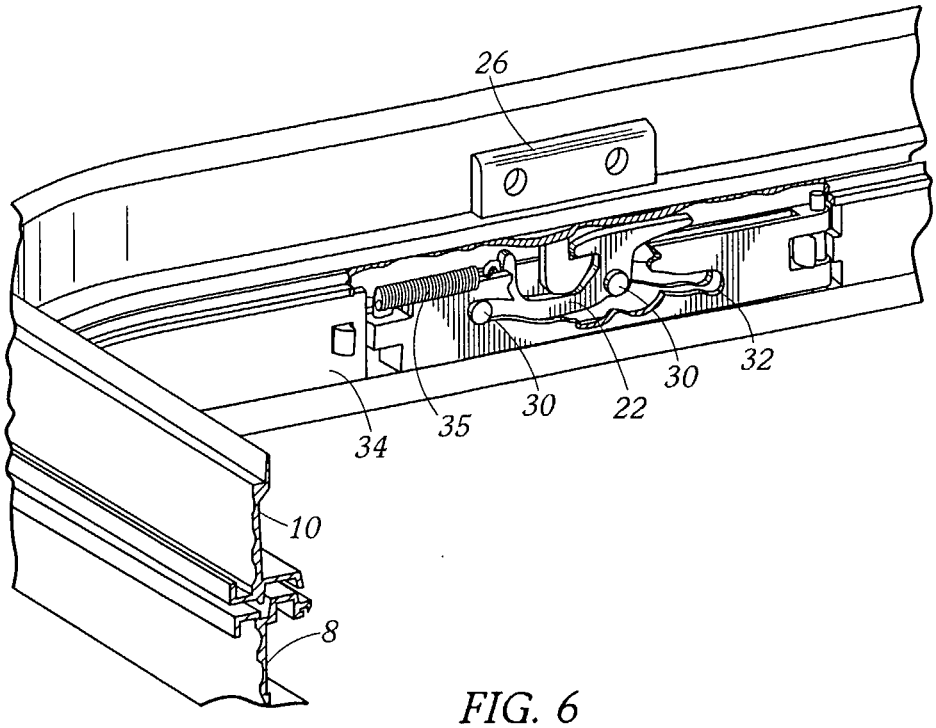
FIG. 6 is a view of the same portion of the upper and lower frames as shown in FIG. 4 now in the pre-close position.

As stated previously, a benefit of the present invention is to provide suitcase 2 with a pre-close position. FIG. 6 illustrates the suitcase 2 in the pre-close position. In the pre-close stage, hook 26 is loosely engaged with catch plate 22. Because the hook/catch plate engagement is loose, a gap remains between base frame 8 and lid frame 10. As shown in FIG. 6, when the MPC 14 is in the pre-close condition/position, cam followers 30 remain in the top portion of the cam 32. In the pre-close position, spring 35 remains in a substantially unextended state. Spring 35 will become extended upon changing the condition of suitcase 2 from the pre-close stage to the secure stage.

Figure 7:
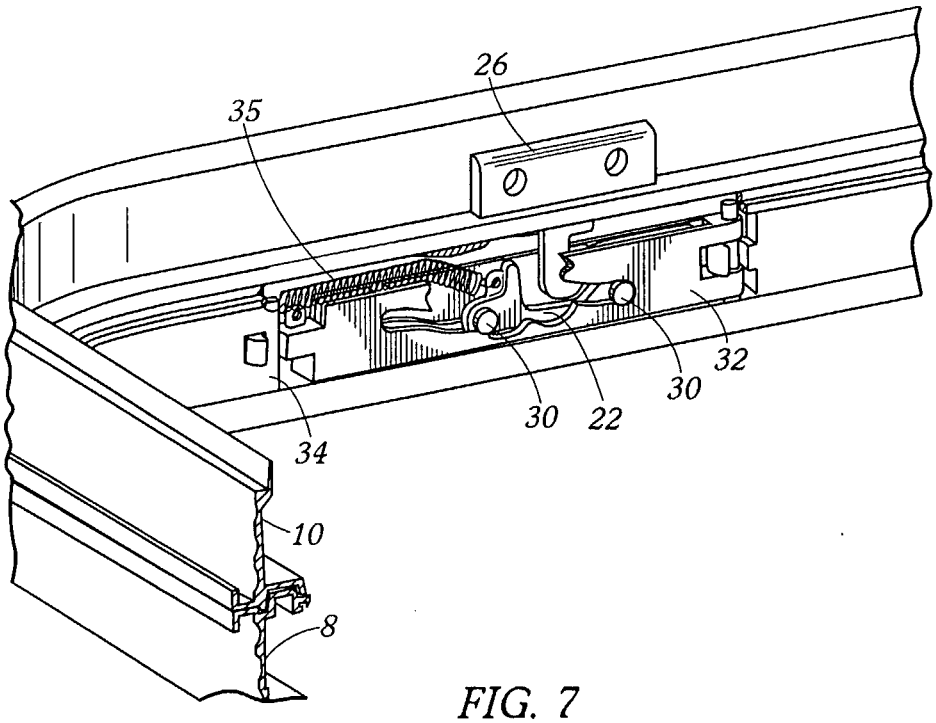
FIG. 7 is a view of the same portion of the upper and lower frames as shown in FIG. 4 now in the secure position.

FIG. 7 is a perspective partial view of the frame portions of the suitcase 2 when in the secure stage. As can be seen FIG. 7, base frame 8 and lid frame 10 are securely pulled together. In the secure configuration, lid frame 10 has been firmly pulled in a downward direction towards base frame 8 to create a secure closure and intimate engagement between the frames. This firm closure is achieved by the downwardly-sloped shape of cams 32. As shown in FIG. 7, cam followers 30 are now at the bottom end of cam 32. At the same time spring 35, which is fixedly attached between carriage 24 and catch plate 22, has been extended. Hook 26 engages catch plate 22, preventing catch plate 22 from moving with carriage 24 as the user pulls the operative lever 16. In this way, cam follower 30 rides the carriage cam slots 32, drawing catch plate 22 and the now fully engaged hook 26 along with lid frame 10, down into a firm, intimate contact with base frame 8. In this securely closed position, the operative lever 16 can be locked by a locking mechanism such as a combination lock 18. From the secure stage, when operative lever 16 is rotated back to a position that is flush with the outer surface of base shell 4 and luggage case 2 is opened, hook 26 releases from catch plate 22 and spring 35 therefore pulls the catch plate 22 back to the open stage.

A benefit of the present invention is that the geometry of hook 26 is such that should spring 35 not be able to provide enough force to pull catch plate 22 back to the open stage (when operative lever 16 is leftmost), when the luggage case 2 is closed, the rounded head 9 of hook 26 will push back on catch plate 22, pushing catch plate 22 back to the open stage.

FIGS. 8, 9, 10A and 10B illustrate one embodiment of the present invention. Referring to FIG. 8, a center lock assembly 50 may be used to carry out the three stages of the multi-point closure system. In this embodiment of the present invention, an operative lever 16 is used to achieve the three stages of the MPC 14: the open stage, the pre-close stage and the secure stage. A rotating handle system 43 may comprise three sections that are of continuous monolithic construction. The three sections include operative lever 16, shaft 46 and drive pinion gear 48. Rotating handle system 43 is mounted securely to base shell 4 by housing 52. In this embodiment of the present invention, housing 52 is fastened to the outside surface of base shell 4 (not shown in FIGS. 8, 9, 10A and 10B for clarity) by mounting screws 54. Of course, housing 52 may be mounted to base shell 4 by any conventional means including bolts, glue, rivets, staples, and so on. Correspondingly, housing 52 may be molded or machined directly into suitcase 2. Housing 52 may also be affixed to the base shell 4 by bosses 56 passing through correspondingly sized holes punched into base shell 4. Housing 52 is held in place by a base plate 58 which is affixed to the inner surface of base shell 4. Base plate 58 may be attached to housing 52 by mounting screws 54. Housing 52 is further held in place by escutcheon 60. Escutcheon 60 is affixed to inner surface of base shell 4 and to housing 52 by mounting screws 54. Base plate 58 and escutcheon 60 comprise screw holes 62 which house mounting screws 54. Mounting screws 54 and bosses 56 may be held in place by a washer and nut assembly or any other assembly suitable for the purpose of this present invention. The center lock assembly 50 may also include a relatively conventional combination lock 18 (as shown in FIG. 2) and safety latch 66.

Figure 10A:
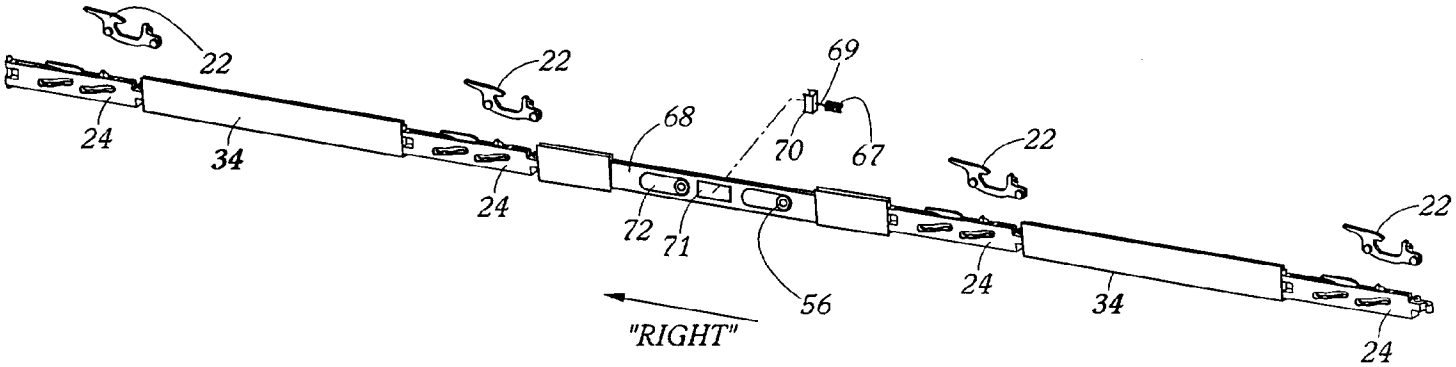
Figure 10B:
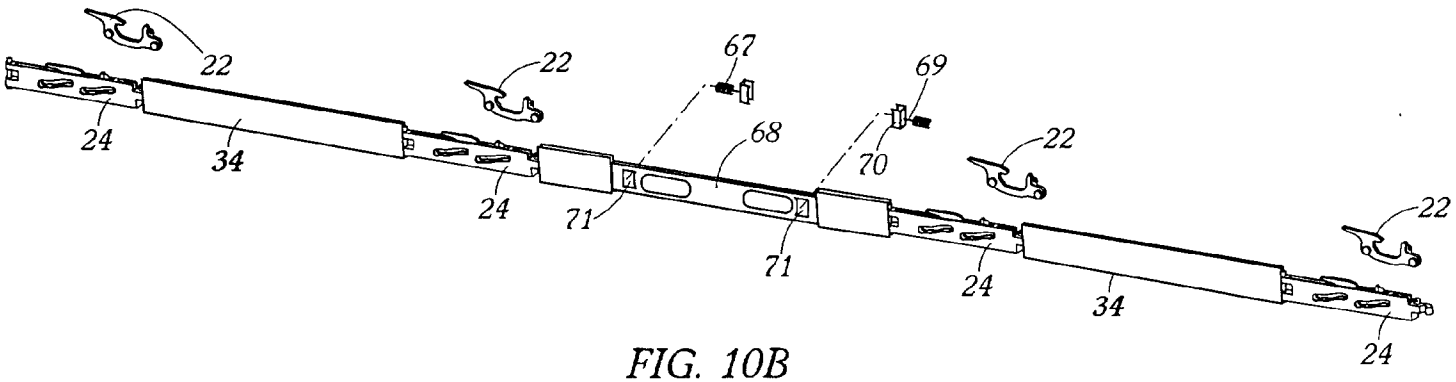

Referring to FIGS. 8 and 10A and 10B, as previously discussed with regard to the description of FIG. 5, drive pinion gear 48 may comprise teeth which mate with knobs 36, teeth, or other mechanisms, located on rack 68. In this way, when operative lever 16 is rotated, drive pinion gear 48 correspondingly laterally moves rack 68. Rack 68 comprises two oblong slots 72. Slots 72 are of such width so as to accommodate bosses 56. As operative lever 16 is rotated, rack 68 is moved either left or right until further lateral motion of rack 68 is prevented by bosses 56. When the multi-point system 14 is in the open position, operative lever 16 rests flush against base shell 4. For purposes of this description, it can be said that when the MPC 14 is in the open position, operative lever 16 maintains a 0.degree. angle of incidence between the outer surface of base shell 4 and the longitudinal plane of operative lever 16. Consequently, rack 68 is in its rightmost position and bosses 56 rest against the leftmost edge of slots 72. Correspondingly, when the MPC 14 is in the open position, base frame 8 and top frame 10 are completely separated. Specifically, rack 68 is in its rightmost position, hook 26 is not engaged with catch plate 22, and cam followers 30 reside in the uppermost portions of cam slots 32.

As operative lever 16 is rotated outwardly from the suitcase (as operative lever 16 is rotated from 0° to a position between 0° and 180°), rack 68 begins to move towards the pre-close condition. When the MPC 14 has reached the pre-close position, rack 68 has moved from its rightmost position to a more central position. That is, bosses 56 now rest in approximately the center portion of slot 72. Correspondingly, hook 26 has engaged catch plate 22 and cam followers 30 are still in the upper most portion of their respective cams 32. At the same time, frames 8 and 10 are separated only by a very small gap (smaller at the hinged side of the suitcase) and each hook 26 and catch plate 22 is securely engaged. Suitcase 2 will become fully engaged upon the full rotation of operative lever 16. Rack 68 is fixedly attached to carriages 24 and portions of flexible link 34 so that the entire MPC 14 assembly moves as one singular unit. Rack 68 may by fastened to carriage 24 by a snap-hook 37 and axle 39. Likewise, all laterally moving components of the MPC 14 are fastened to each other by a snap-hook 37 and axle 39 configuration. Snap-hook 37 and axle 39 are located on the extreme ends of rack 68, each carriage 24, and each flexible link 34. For example, referring to FIGS. 12A, 4A, 4B, 4C, and 4D, snap hook 37, located on extreme left end of carriage 24, is snapped into place over axle 39 located on the extreme right end of rack 68. This construction allows for several combinations in size and sequence of rack 68, carriage 24, and flexible link 34. For example, the order of these MPC 14 components could be rack 68-carriage 24-link 34-carriage 24, rack 68-link 34-carriage 24 (with a larger distance between components), or rack 68-carriage 24-link 34-link 34 (to accommodate larger luggage cases). Furthermore, the asymmetrical combination prevents reverse assembling. Changing the order of the MPC components also allows an easy way to vary the position and the number of locking mechanisms. A significant advantage of using a snap-hook 37/axle 39 configuration is ease of rotation between the components, which facilitates assembly when the MPC system 14 is slid past the corners of the luggage case 2. Furthermore, this simple method of assembly allows luggage cases of any size to be assembled with the MPC 14. Repeated construction of these MPC components (rack 68, carriage 24, and flexible link 34) reduces manufacturing costs and allows for MPC luggage cases of various sizes and shapes to be assembled, thereby removing the need for multiple manufacturing systems to accommodate different sizes/types/shapes of luggage cases. Conversely, the laterally moving parts of MPC 14 can be connected by any other means including glue, staples, thread, pins, etc.

Figure 11:
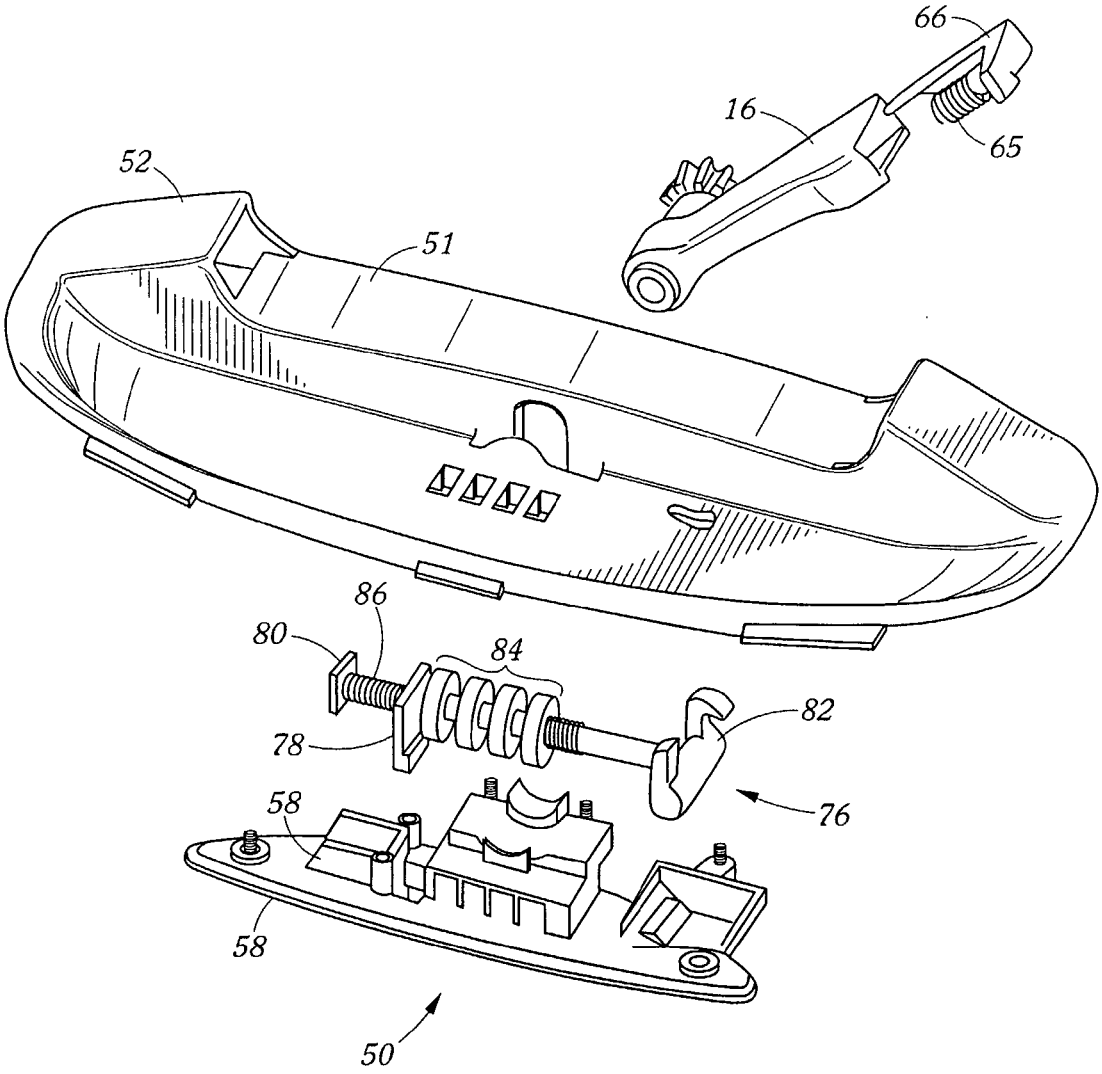
FIG. 11 is an exploded view of the center lock assembly with a combination lock and safety latch.

The user may now securely fasten their suitcase 2 by fully engaging every latching mechanism and squeezing the lid shell 6 and base shell 4 even closer together by means of the present invention. Securing the suitcase 2 and pulling the shells closer together is accomplished by rotating operative lever 16 from the pre-close position to the secure position of 180°. The operative lever 16 is now flush with the outer surface of base shell 4 and with housing 52. Referring to FIG. 11, housing 52 includes a molding 51 designed to surround the operative lever 16. When the suitcase 2 is in the secure stage, rack 68 has moved into its leftmost position and bosses 56 rest against the rightmost edges of slots 72. Correspondingly, cam followers 30 have been forced downward along cams 32 to achieve the drawing action of shells 4 and 6 (and of frames 8 and 10) central to the present invention. Thus the open, pre-close and secure positions have been successfully achieved by the manual operation of the operative lever 16 by the user. This creates a simple and effective method of locking one's suitcase. Another advantage of the present invention is that by employing a three stage closing system, improper packing of one's suitcase does not preclude the suitcase from securely locking. For example, if a piece of clothing should block one hook 26 from fully engaging with the latch's corresponding catch plate 22, the other hooks 26 should still successfully engage the other corresponding catch plates 22. In addition, there is no need for the user to check each latch point for a proper engagement because the rotation of operative lever 16 ensures the proper alignment of each latching mechanism.

Figure 9:
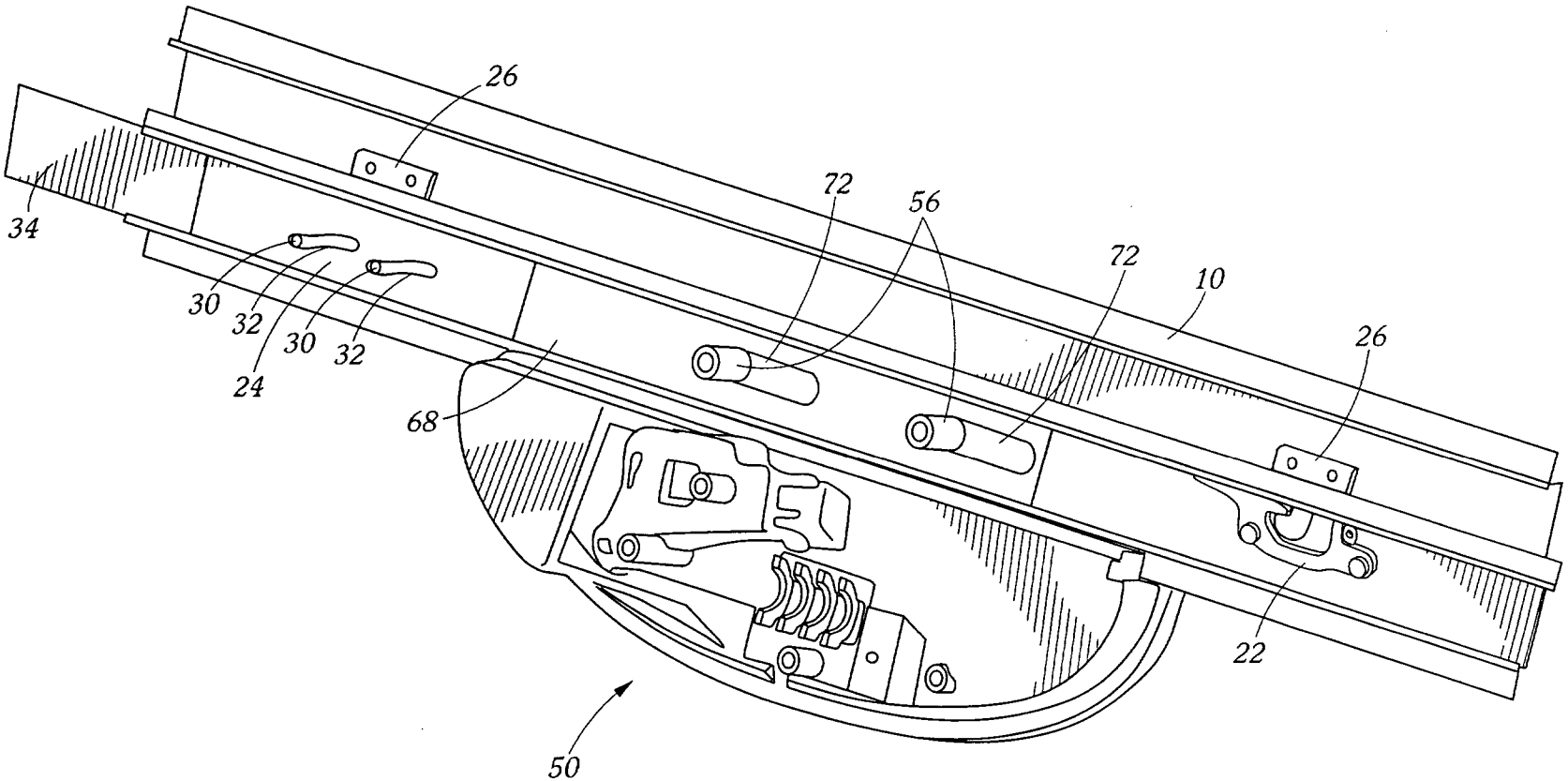

FIG. 9 shows the Multi-point closure system 14 in the fully secure position. As shown in FIG. 9, boss 56 rides along rightmost edge of slot 72 and hooks 26 are securely engaged with catch plates 22. Also shown in FIG. 9 is rack 68 which is in its leftmost position. Carriage 24 encloses cam followers 30 in the lowest portion of cam 32. Flexible link 34 is only partially shown in FIG. 9. Flexible link 34 continues to wrap around the first two corners of base frame 10.

Another useful feature of the present invention is a spring-biased actuator 70 that biases operative lever 16 in the open position. Referring to FIG. 10A, actuator 70 slides within actuator slider 71, a slot that has been machined out of rack 68. Actuator 70 comprises actuator post 69 that is fixedly attached to rack 68. A spring 67 surrounds actuator post 69. When the MPC 14 is in the fully open position, the spring 67 is compressed. As rack 68 slides to its rightmost position, actuator post 69 also moves right, while actuator 70 is stopped by boss 56. Since the compression force is to the right, the force of the spring pushes back left on the operative lever 16, thereby forcing operative lever 16 to remain in the 0° position (flush with molding 51). Of course, other configurations of spring and actuator mechanisms may be used in order to keep the operative lever 16 flush with the suitcase. This prevents the operative lever 16 from jutting out and causing a possible hazard. For example, spring biased actuators 70 could be present on either side of the tooth portion of the rack 68, as shown in FIG. 10B. One actuator could be used in the aforementioned way, and the other actuator could be used to help align rack 68 so that the hook 26 can fully engage with catch plate 22. In yet another embodiment of the present invention, one spring may be used to keep the operative lever in the 0° position while the other actuator could be used to open the operative lever from the 0° position to a position between 0° and 180°.

Figure 12A:
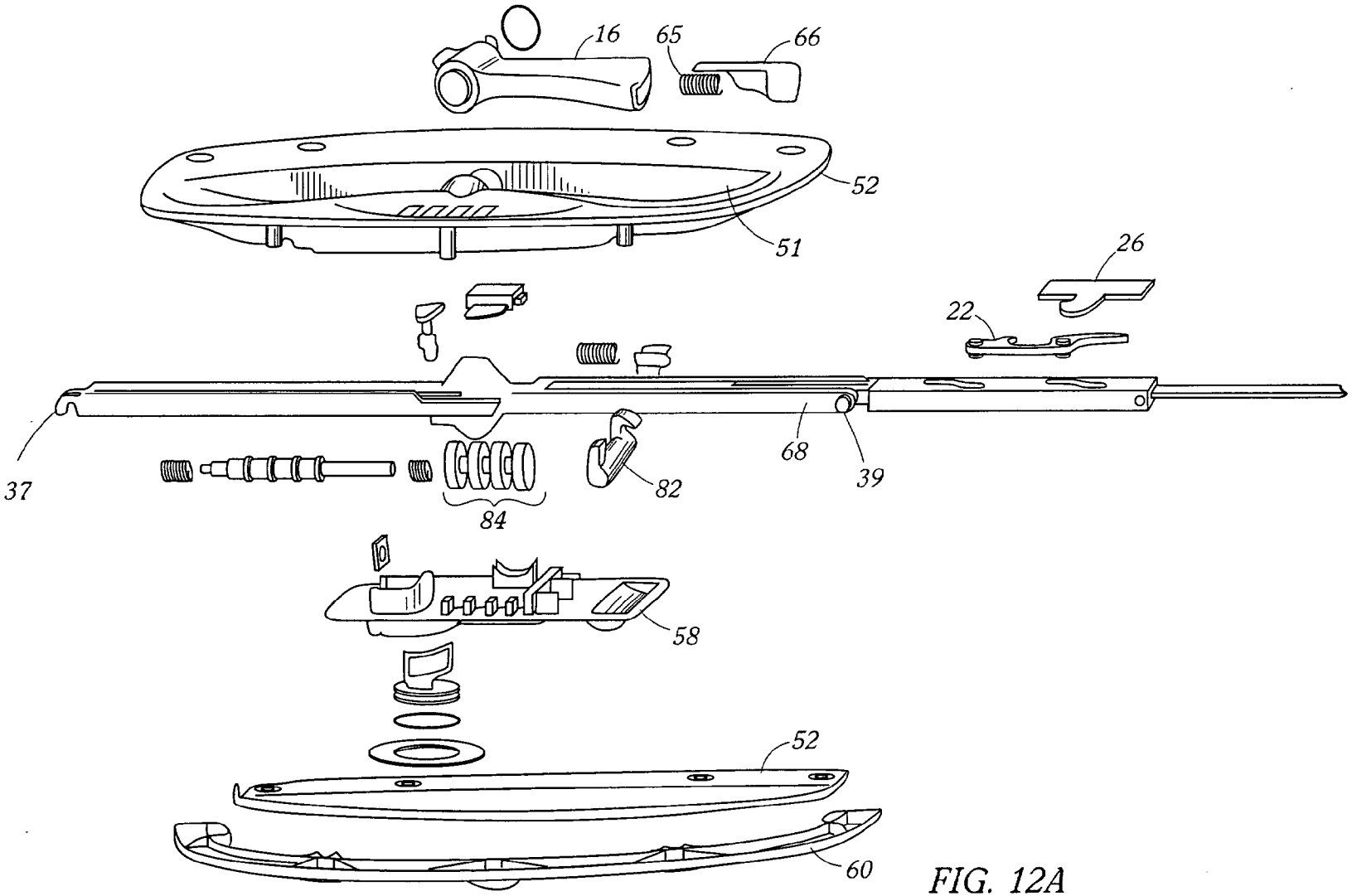
FIGS. 12A and 12B are exploded views of the housing, rack, center lock assembly, and base plate.
Figure 12B:
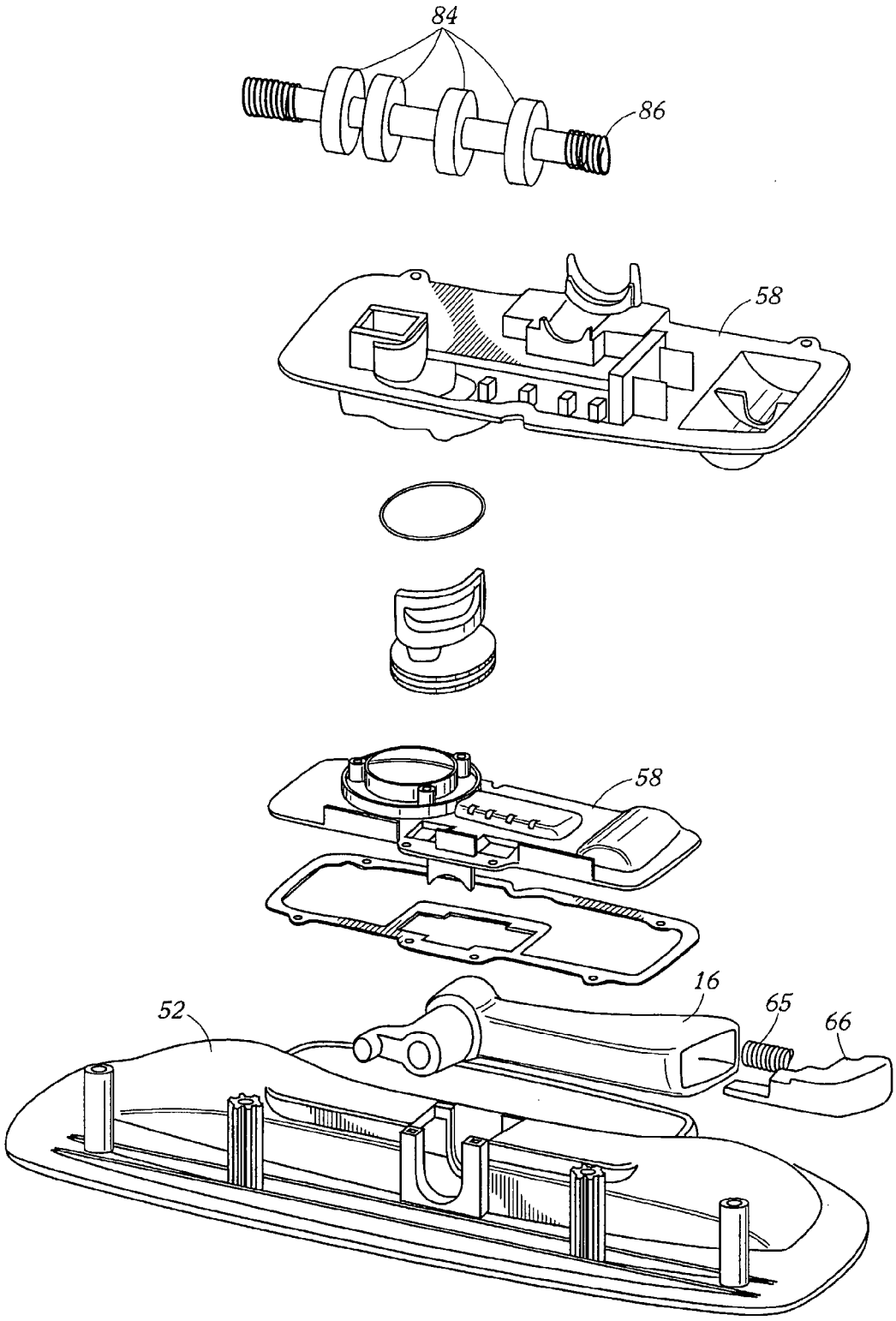

Rotating handle system 43 may also comprise a safety latch 66. Referring FIGS. 11 and 12, safety latch 66 comprises a solid member having a safety spring 65. This safety latch 66 functions similarly to that toggle 60 shown in U.S. Pat. No. 5,111,290 assigned to the assignee of the present invention. The center lock assembly 50 may further comprise a combination lock 76. Combination lock 76, as shown in FIG. 11, may comprise a system of permutation dials 84, a combination lock bolt 82, a mount 80, and a lever 78, that can be used by a user to lock their suitcase. Combination lock 76 also comprises a combination lock spring 86, and when "off combination", lock 76 blocks the movement of member 82, and permits safety catch to move member 82 when "on combination" in a manner well known in the art. It should be noted that a variety of locks could be used in conjunction with the present invention. Additional locks may include key operated locks, code-pads, other locks, or a combination of locks.

Referring again to FIG. 11, base plate 58 is fastened to the inner surface of base shell 4 to which housing 52 is affixed from the outside surface of base shell 4. Combination lock 76 is attached to the outer surface of base shell 4 and held in place, on the outside of base shell 4, by housing 52, and on the inside of base shell 4, by base plate 58.

Figure 13:
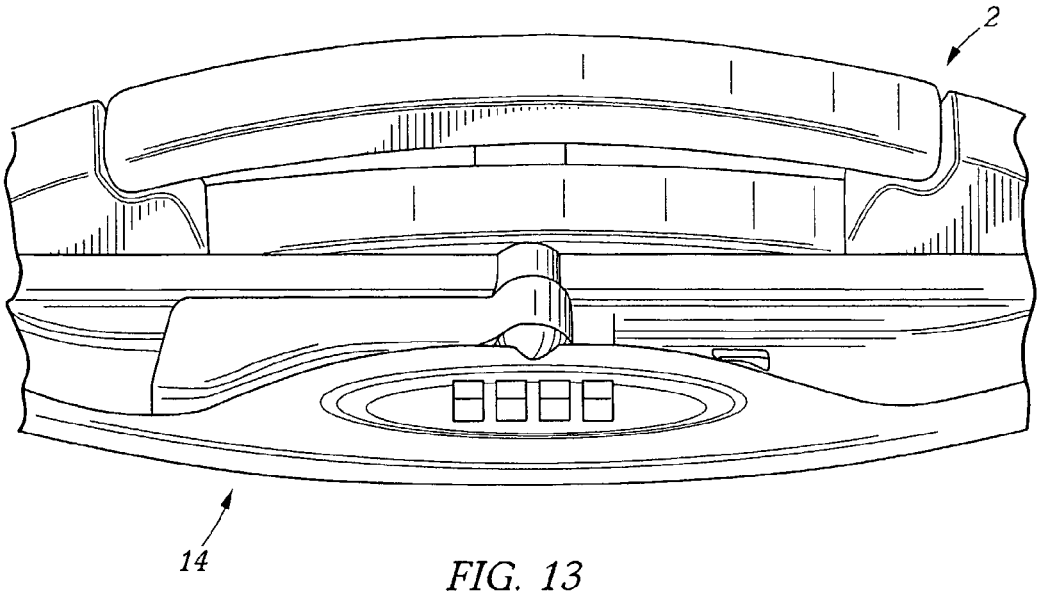
FIG. 13 is a top view from the outside of a luggage case having the MPC 14.

FIG. 13 shows a top view from the outside of a luggage case 2 having the MPC 14.

Figure 14:
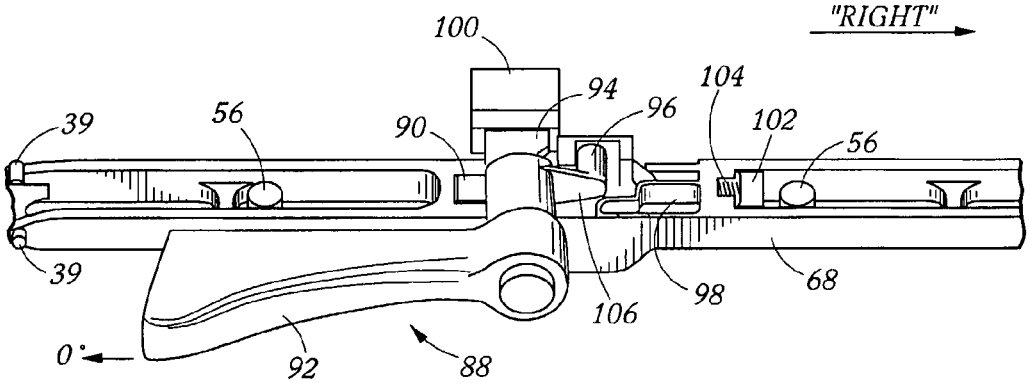
FIGS. 14 through 30 represent a sequence of events of the multi-point closure system ranging from the closed position to the secure position.

FIGS. 14 through 30 represent a sequence of events showing the full range of motion of a second preferred embodiment of the MPC 14. These figures illustrate a progression from an open position to a pre-close position to a secure position and back again to an open position. The benefits of the Multi-point closure system can be achieved by automated methods. Referring to these figures, a rotating handle system 88 and a cam device 90 are shown. This arrangement differs from the geared rack and pinion operating mechanism. As previously discussed with regard to the description of FIGS. 1 through 12, the three stages of the Multi-point closure mechanism include an open stage, a pre-close stage and a secure stage. Rotating handle system 88 comprises three sections constructed of a continuous homogeneous material. The three sections include operative lever 92, lever shaft 94 and bell crank 96. As shown in FIG. 14, rotating handle system 88 causes lateral movement of rack 68 thereon. As before, operative lever 92 comprises a contoured surface for easy manual manipulation. Of course, size, shape, and type/design of operative lever 92 can vary depending upon the intended use and/or aesthetics of the present invention. Operative lever 92 could comprise a dial, crank, button, or any other mechanism. Operative lever 92 is shown to pivot rotationally around center of shaft 94. As shown in FIG. 14, an indentation 98 is molded within rack 68 to accommodate operative lever 92 in the secure/180° position. Also shown in FIG. 14 is a detent trigger 100. The system shown in FIG. 14 is in the fully open position. A spring-biased actuator 102 supports a spring 104. In the fully open position, spring 104 is in a compressed state. Thus the force of spring 104 pushes the rotating handle system 88 leftward, forcing operative handle 92 towards the base shell 4 (0°). This advantageous feature of the present invention prevents operative lever 92 from popping out and causing potential harm or annoyance. An important benefit of the spring 104 is that by keeping the MPC 14 in the open position, spring 104 allows the user to use both hands to lift lid shell 6. As discussed previously with regard to the descriptions of FIGS. 9, 10A and 10B, boss 56 serves as a stop for spring-biased actuator 102, causing compression of spring 104. In addition, rack 68 is in its rightmost position.

Figure 15A:
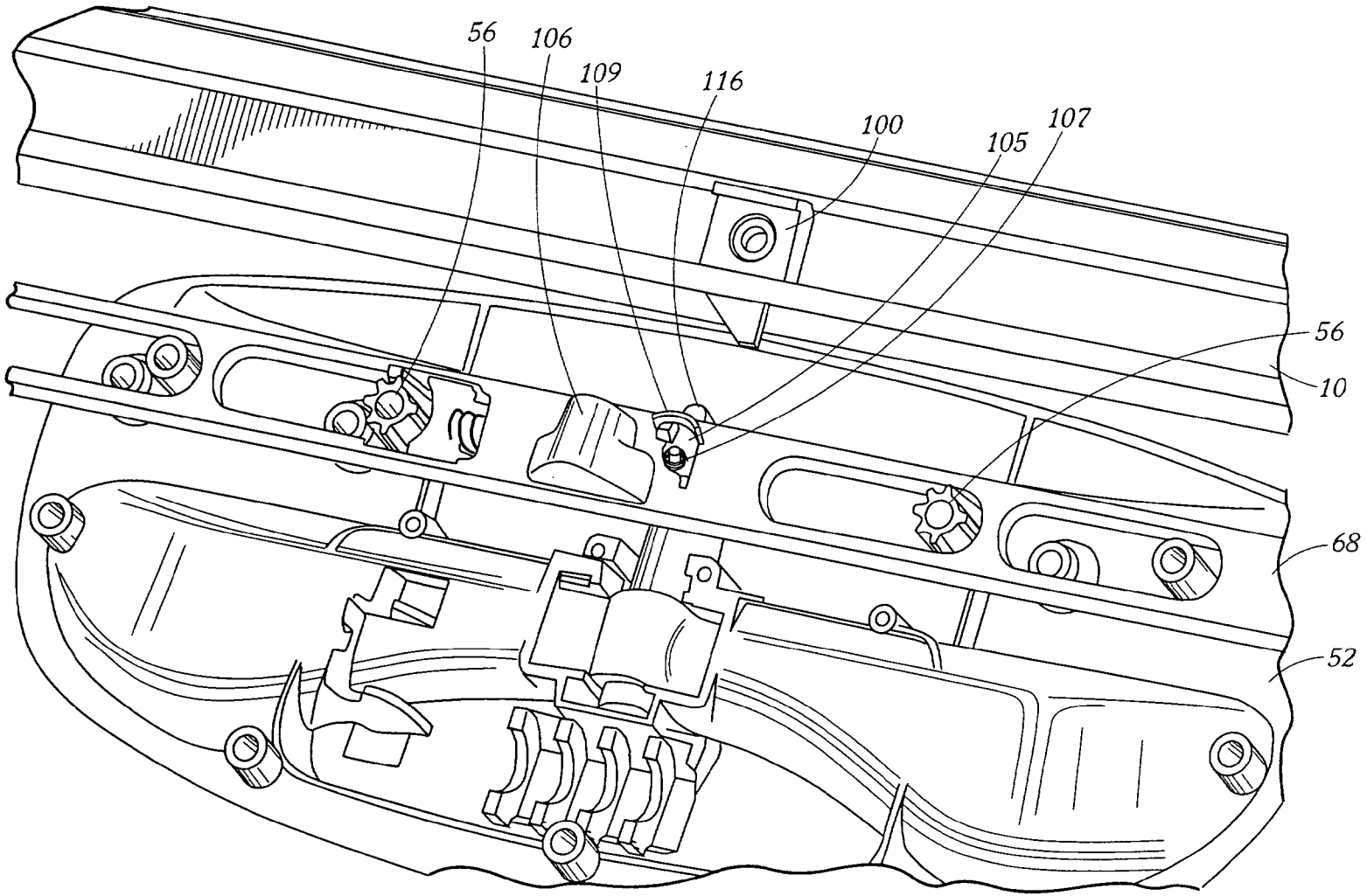
Figure 15B:
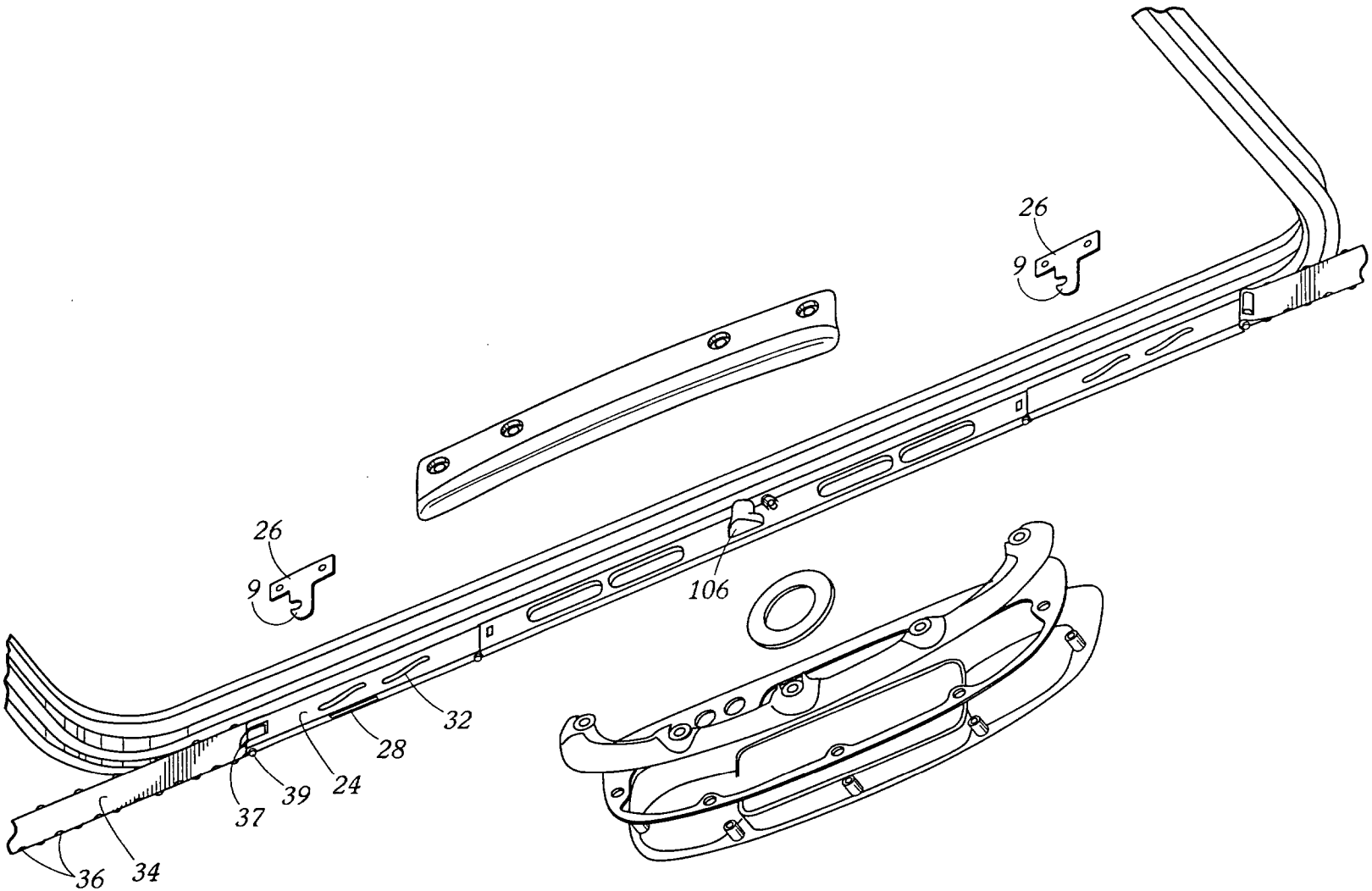
Figure 16A:
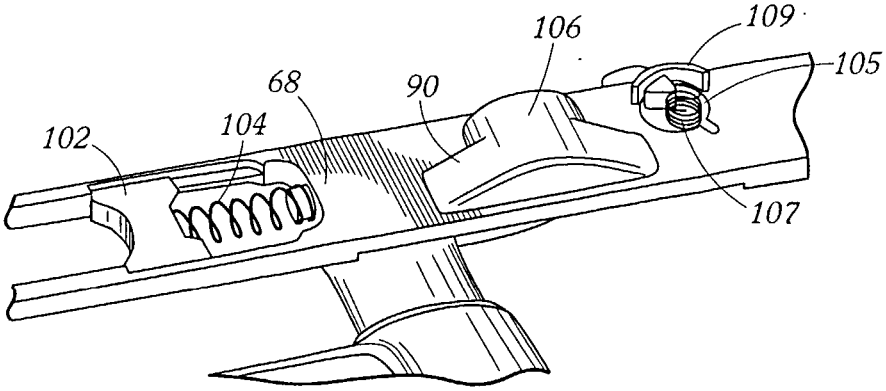
Figure 16B:
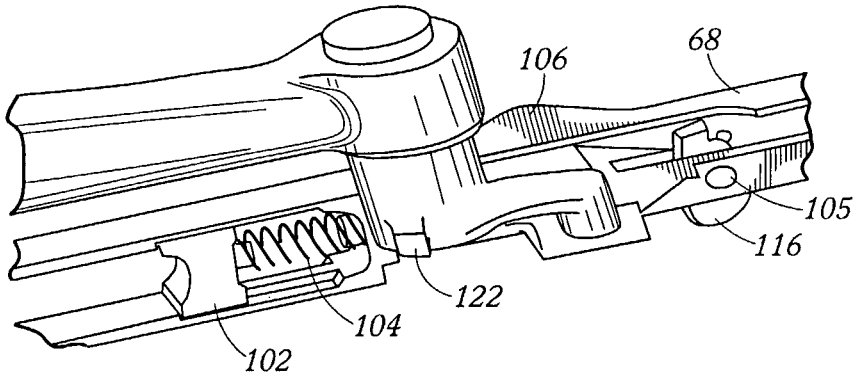
Figure 16C:
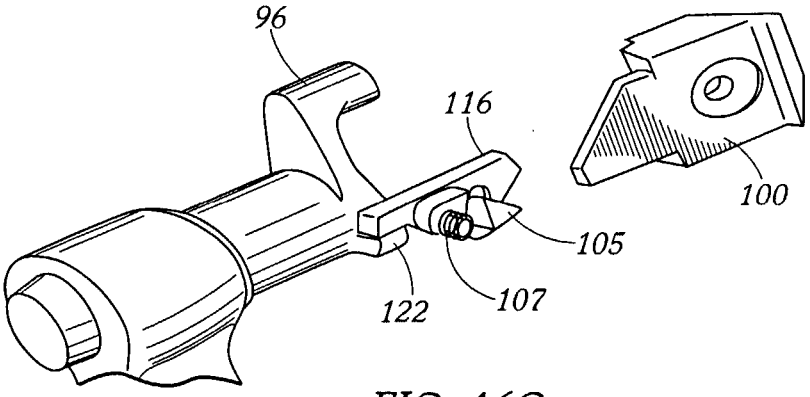

FIGS. 15A and 15B represent a view, from the inside of luggage case 2, of the MPC 14 in an open position. Shown in FIG. 15A are the assembled housing 52 and rack 68, as well as lid frame 10. Lid frame 10 accommodates detent trigger 100. Detent trigger 100 is aligned with a detent 116. As shown in FIGS. 15A, 16A, 16B, and 16C, detent 116 is mounted on a pivot axle 105 and positioned by a torsion spring 107. Pivot axel 105 rests on a protrusion 109 that has been molded within rack 68.

Figure 17:
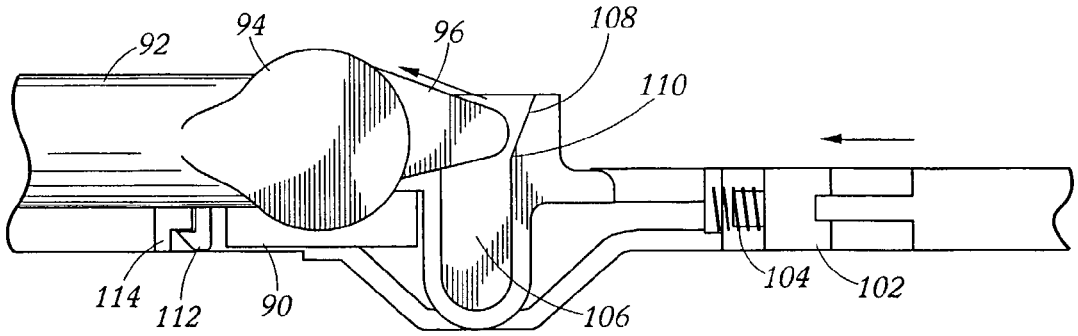
Figure 19:
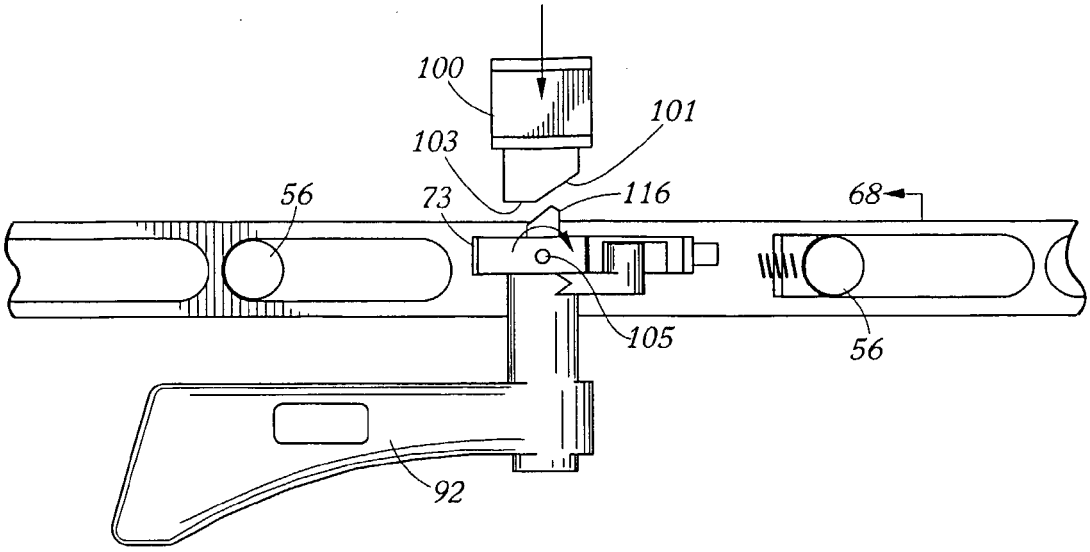

FIG. 17 is a bottom view of the MPC 14 in its open stage. As shown in FIG. 17, cam device 90 comprises a rack cam 106. Rack cam 106 is of such a dimension so as to accommodate bell crank 96. Rack cam 106 further comprises chamfer 108 extending from dead center point 110. In the open position, the force of the spring 104, transmitted through contact between chamfer surface 108 and bell crank 96, causes the operative lever 92 to remain in the 0° position. Also shown in FIG. 17 is a means for fixedly attaching cam device 90 to rack 68. Cam device 90 may be attached to rack 68 by slot 73, as shown in FIG. 19, and snapped into place by a cam device hook 112. Cam device hook 112 may snap into place by mating with a rack mating hook 114. Other means may be used to attach cam device 90 to rack 68 including pins or other methods. It may be beneficial to provide an easily replaceable part upon the occurrence of wear and tear. Cam device 90 and rack 68 can be constructed of material that is similar or dissimilar to the material used to construct rack 68. Indeed, Rack cam 106 can be machined or molded directly into rack 68 as shown in FIGS. 15A and 15B.

Figure 18:
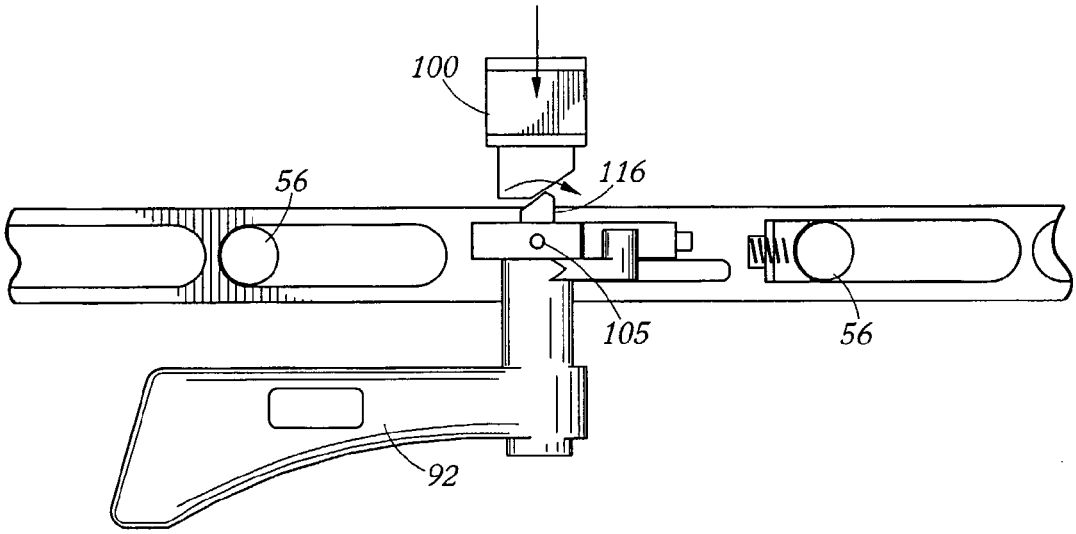

Referring to FIG. 18, as the user begins to close the suitcase, the MPC 14 transitions into the pre-close stage. A downward force is applied by a detent trigger 100. Detent trigger 100 may comprise a solid piece that is attached to the lid shell 6 of the suitcase. A significant advantage of this embodiment of the present invention is that the Multi-point closure system 14 may be enforced automatically. That is, alignment of hook 26 and catch plate 22 may be done by automated means. These automated means will become evident within the descriptions of the following figures. As shown in FIG. 18, detent trigger 100 comes into contact with a detent 116. Detent 116 is able to rotate around pivot axel 105 that is located between cam 90 and rack 68. Detent 116 is mounted on torsion spring 107. The torsion spring 107 provides a spring-back motion so that detent 116 may return to its resting position shown FIG. 18. Detent 116 is shown in greater detail with regard to description of FIG. 19 and FIG. 20.

Figure 20:
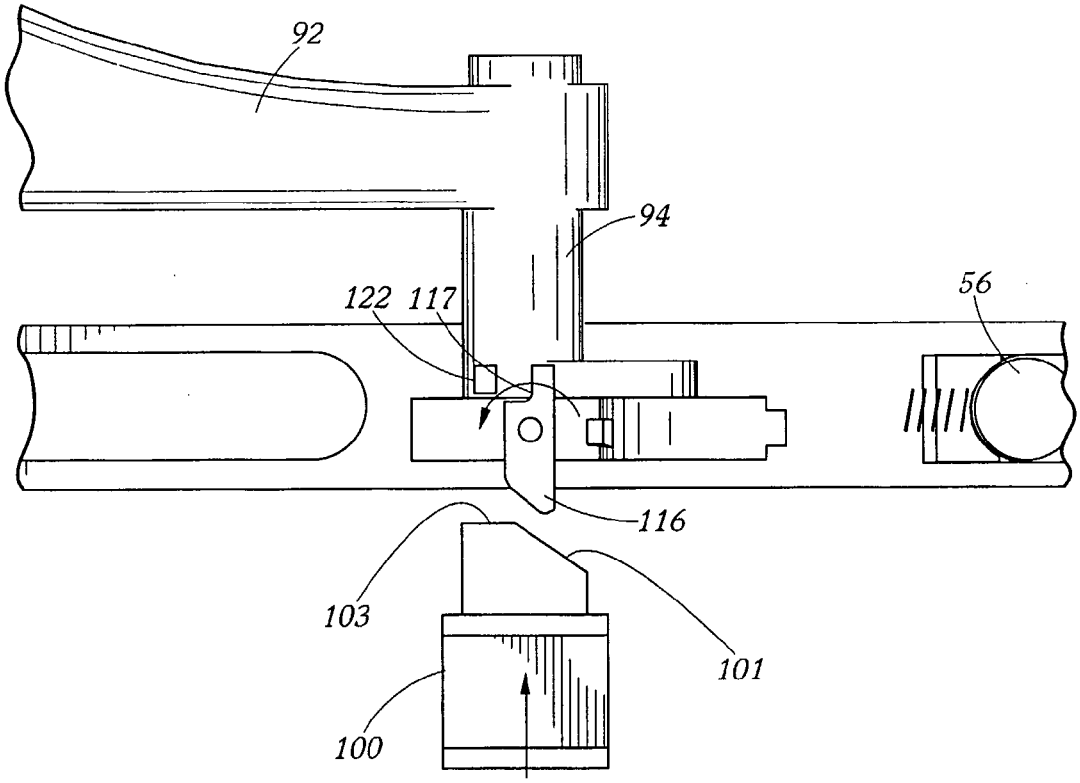
Figure 21:
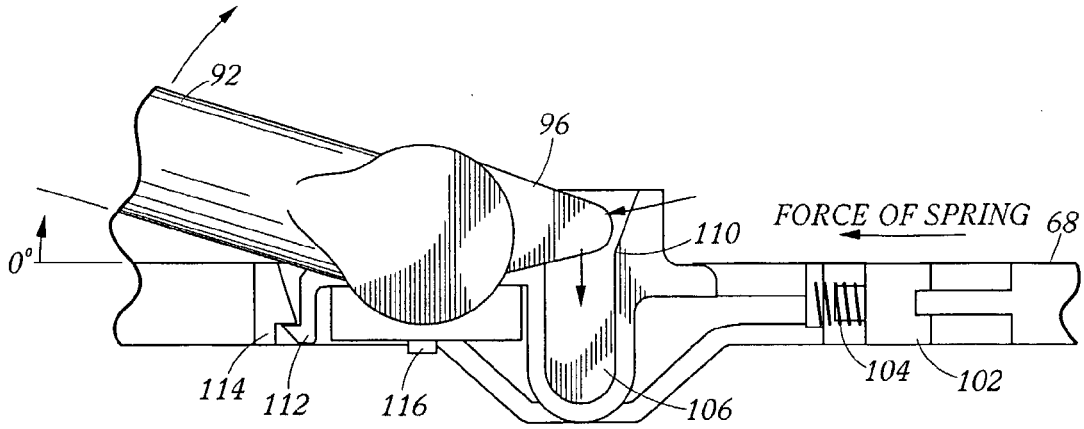

FIG. 19 is a front view of this embodiment of the present invention. Referring to FIG. 19, as detent trigger 100 is dropped, detent 116 rotates clockwise. Detent trigger 100 comprises a sloped portion 101 and a flat portion 103. As the sloped portion 101 of detent trigger depresses detent 116, detent 116 is forced clockwise. Referring to FIG. 20 which shows a portion of the cam cut away for clarity, upon rotation, detent 116 forces operative lever 92 to rotate. As shown in FIG. 20, detent 116 comprises an arc 117 that meets with a shoulder 122 formed on lever shaft 94. Referring to FIG. 21, detent 116 rotates the operative lever 92 enough to pass the dead center point 110 of rack cam 106. From this position, spring 104 and actuator 102 push rack 68 the remainder of the way to the pre-close position, where hook 26 is engaged with catch plate 22 but the lid shell 6 is not completely drawn down. The actuator 102 has an approximate range of lateral motion of 6.5 mm, resulting in an angle of approximately 65° of operative lever 92 from luggage case 2. In other words, once bell crank 96 has passed dead center point 110, the force of the spring 104, through sliding contact between bell crank 96 and the cam device 90, has caused a further clockwise moment of operative lever 92 allowing bell crank 96 to traverse the full length of rack cam 106. Thus, as operative lever 92 undergoes rotational movement, cam device 90 undergoes proportional lateral movement. That is, as the lifting lever rotates from 0° to some intermediate position, the rack 68 laterally moves from right to left. Of course, rack 68 moves along with cam device 90 because cam device 90 is fixedly attached to rack 68. As rack 68 laterally moves, the hook 26 and catch plate 22 mechanisms begin to align. Thus, by deploying the detent trigger 100, the latching mechanisms are automatically aligned and placed in the pre-close position. A benefit of the present invention is that by protruding from the luggage case 2, operative lever 92 provides a visible indication to the user that the luggage case 2 is in the pre-close position, wherein all latching mechanisms have been successfully engaged, and the luggage case 2 is not yet in the secure position (the luggage case 2 is not yet locked). To progress to the secure position, all the user need now do is simply rotate operative lever 92 the remainder of the way to the full 180°, flush with luggage case 2.

Figure 22:
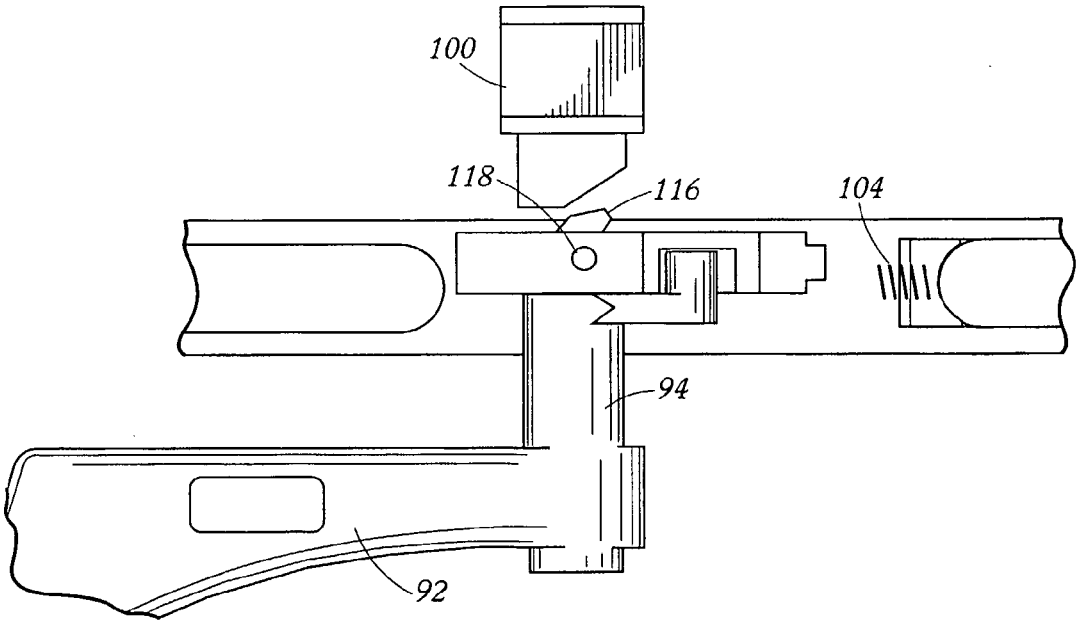
Figure 23:
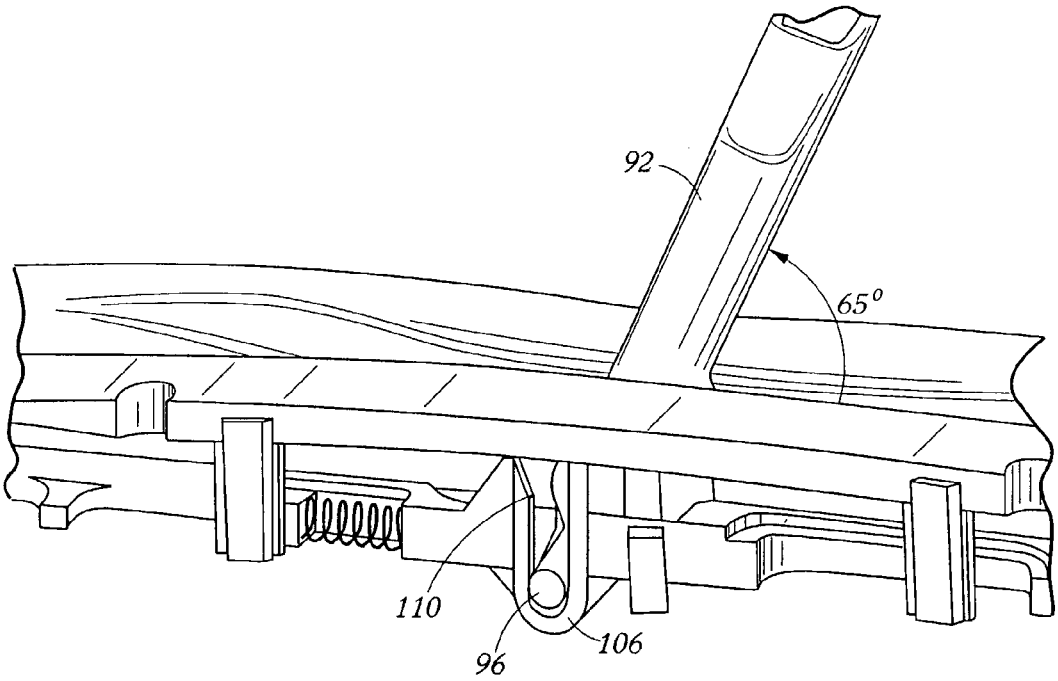
Figure 24:
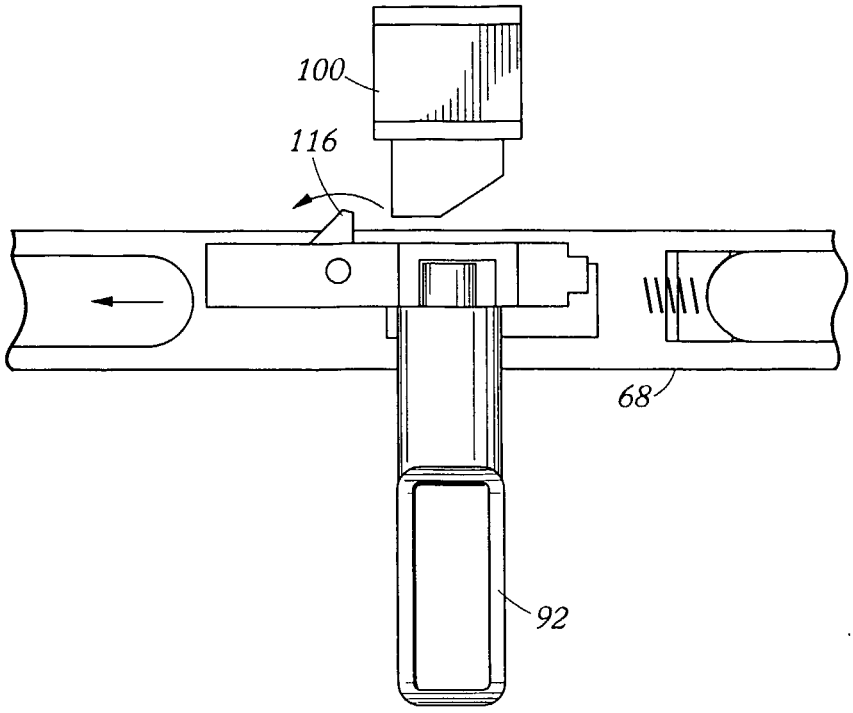

FIGS. 22 and 23 illustrate the MPC 14 in the pre-close position. FIG. 23 is a cross-sectional view of the MPC 14 from inside the luggage case 2. Bell crank 96, after passing dead center point 110, is now in the lowest portion of cam rack 106. Correspondingly, operative lever 92 is at an angle of approximately 65° from the luggage case 2.

Figure 25:
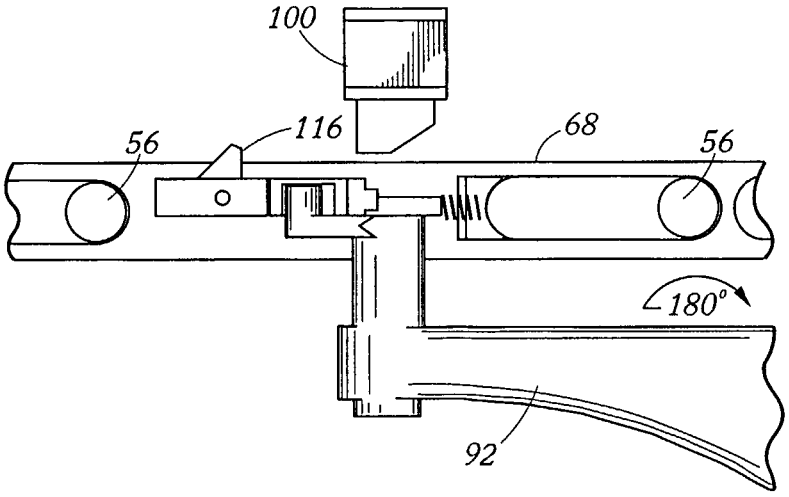

Now the suitcase may be set in the secure position. To achieve the secure position, operative lever 92 is rotated fully to 180°. That is, operative lever 92 again becomes flush with the base shell 4, only now the end of operative lever 92 is pointing in the opposite direction of the open position. Referring to FIG. 25, rack 68 is now in its leftmost position, each latching mechanism is perfectly aligned and locked, and base shell 4 and lid shell 6 are pulled firmly together by the action of the cam followers 30 being forced into the lowest part of the cam 32, as shown in FIG. 7.

We have detailed a detent trigger 100 and detent 116 mechanism that communicates the position of the lid shell 6 just as it is closing, so that the detent 116 can condition the catch plates 22 (through operation of the drive mechanism 14) to place the catch plates 22 in the pre-close position. But our invention contemplates other conditioning or communicating systems and thus embraces other sequence of operations. For example, other detent mechanisms could operate to sense when the lid shell 6 is being lifted from the base shell 4 (e.g, after the operating lever, etc. has placed the catch plates 22 in the "open position"), and immediately condition the catch plates 22 to place them in the pre-close position.

Figure 25A:
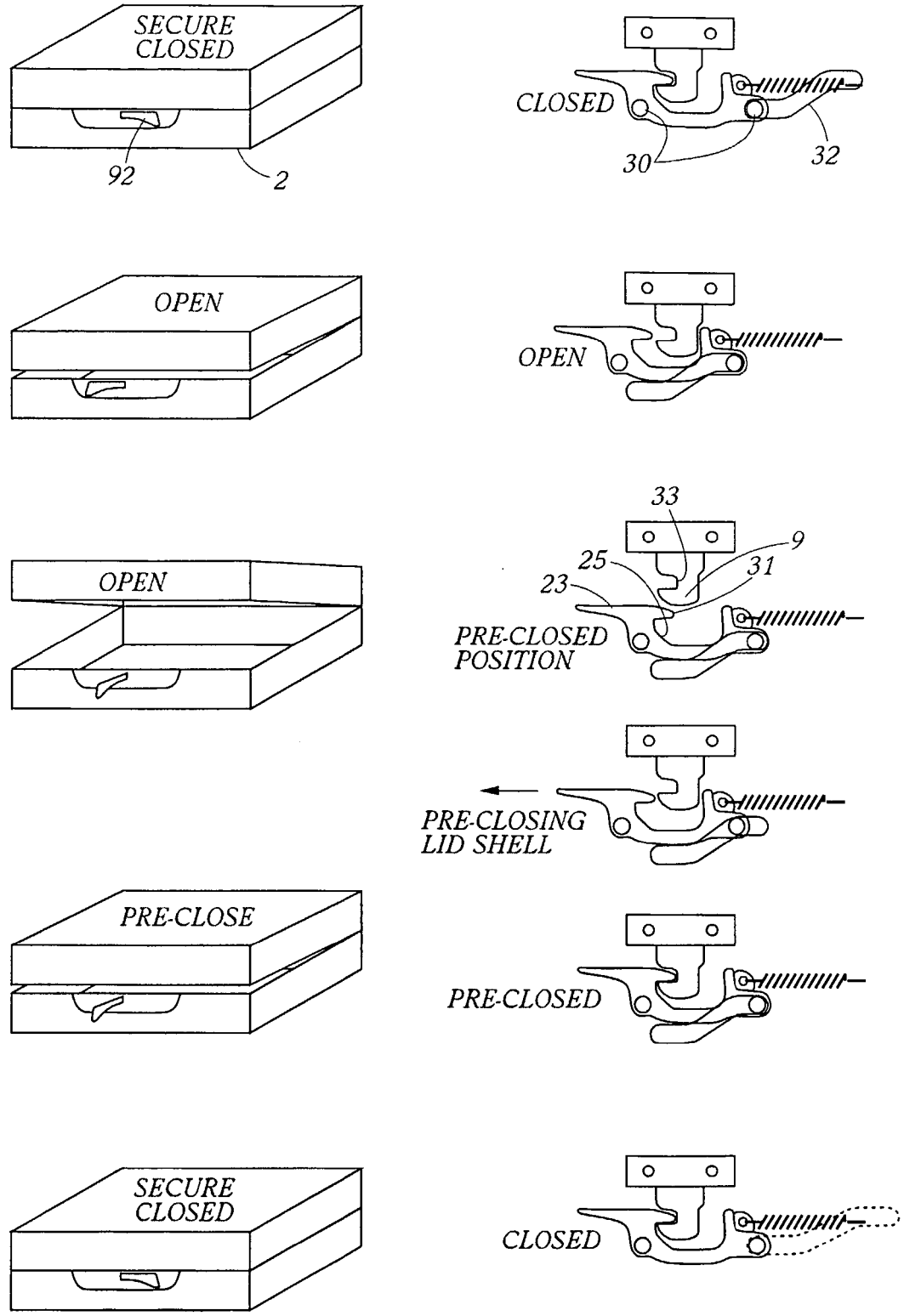
FIGS. 25A and 25B represent a sequence of events showing how a reassuring "click" sound is made as a source of feedback to the user.
Figure 25B:
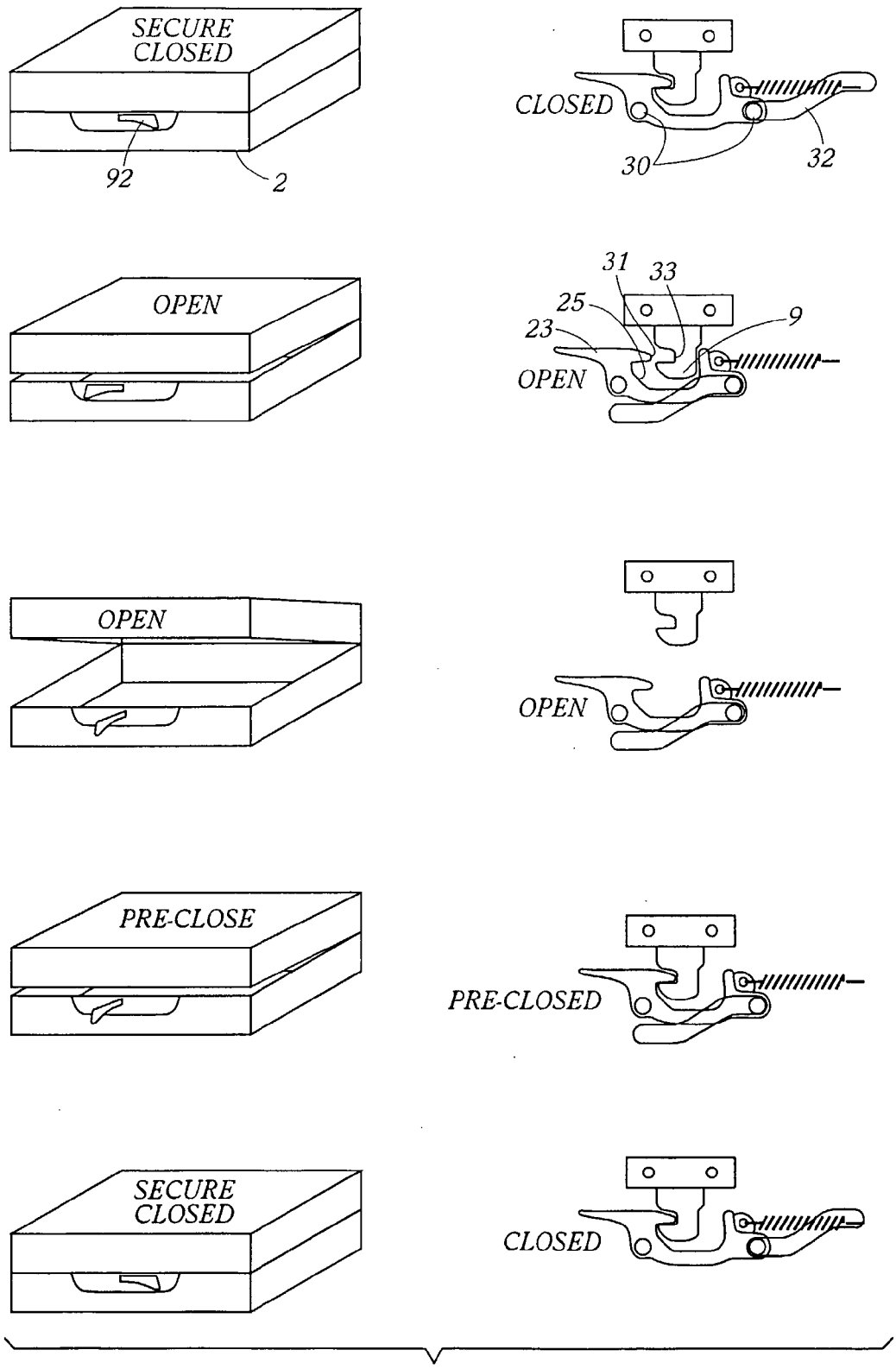

Referring to FIGS. 25A and 25B, it is important to note that the luggage case 2 can be closed when operative lever 92 juts out from luggage case 2 and luggage case 2 is in what may be referred to as a "pre-pre-close" position. In the pre-pre-close position, lid shell 6 is flipped open (or at least is not in contact with base shell 4), operative lever 92 is jutting out from the luggage case 2 to a position somewhere between 0° and 180°, and a portion of the horizontal portion 31 of catch plate 22 can be seen through opening 28. The pre-pre-close position allows the hook(s)-26 to loosely engage the catch plate(s) 22. Upon closing lid shell 6 onto base shell 4, an audible "click" is heard by the user. This "click" is indicative of the hook(s) 26 and the catch plate(s) 22 firmly engaging. At this time, the luggage case 2 is in a true pre-close condition. The click is created by horizontal portion 31 of catch plate 22 meeting receiving portion 33 of hook 26 as shown in FIGS. 4, 4C, and 25A and 25B. An important advantage of the click feature is providing the user with feedback so the user knows that the luggage case 2 is secure.

It can therefore be seen that the present invention not only provides a method and system for achieving several stages of closure, including a very useful secure stage in which extra drawing together of the suitcase shells is achieved, but that such a secure closure can be accomplished automatically. The pre-close stage, also a very useful stage, can be reached automatically by means of the detent trigger 100, detent 116, rack cam 106, and the latching mechanism. The pre-close stage provides a sure, secure condition of a suitcase 2 so that a user need not manually check each latching mechanism for alignment, even when an improperly packed item hinders some of the latching mechanisms.

Figure 26:
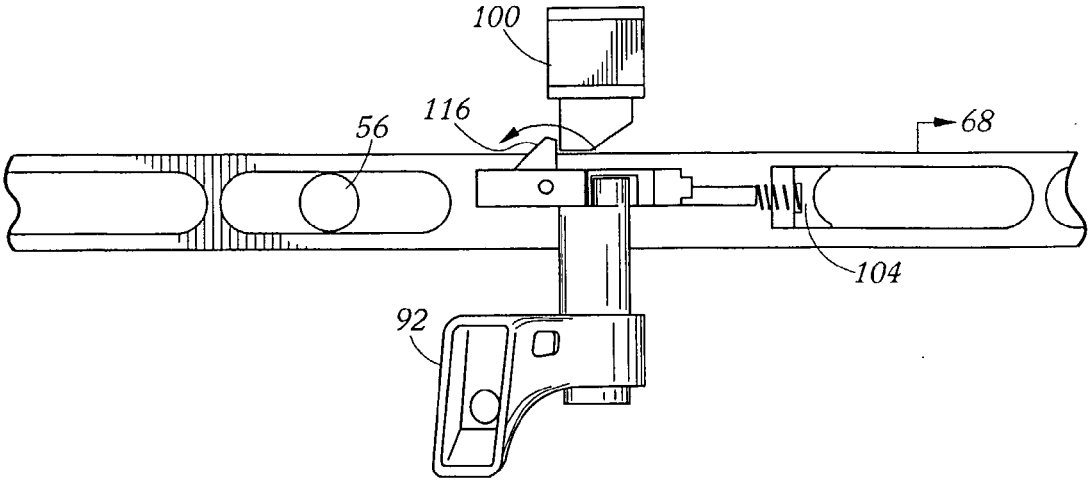
Figure 27:
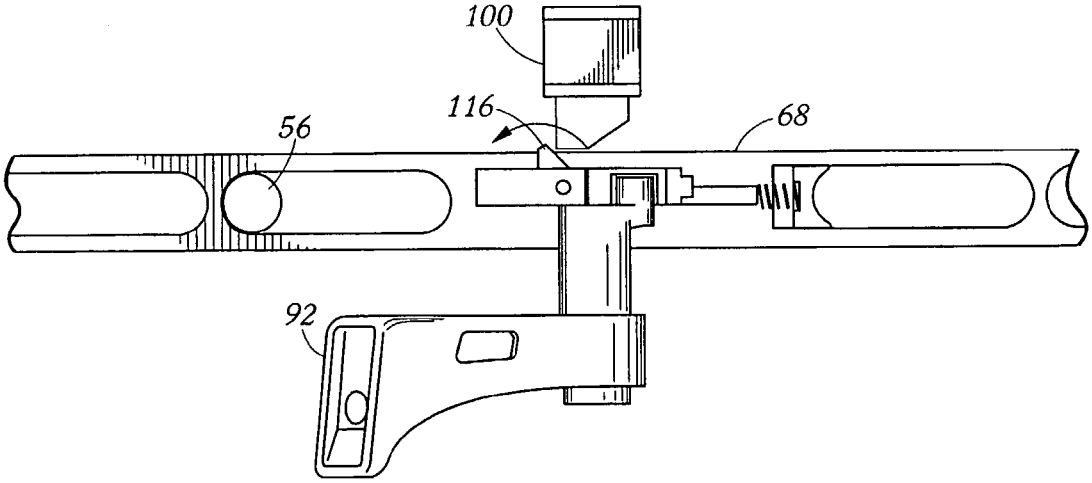
Figure 28:
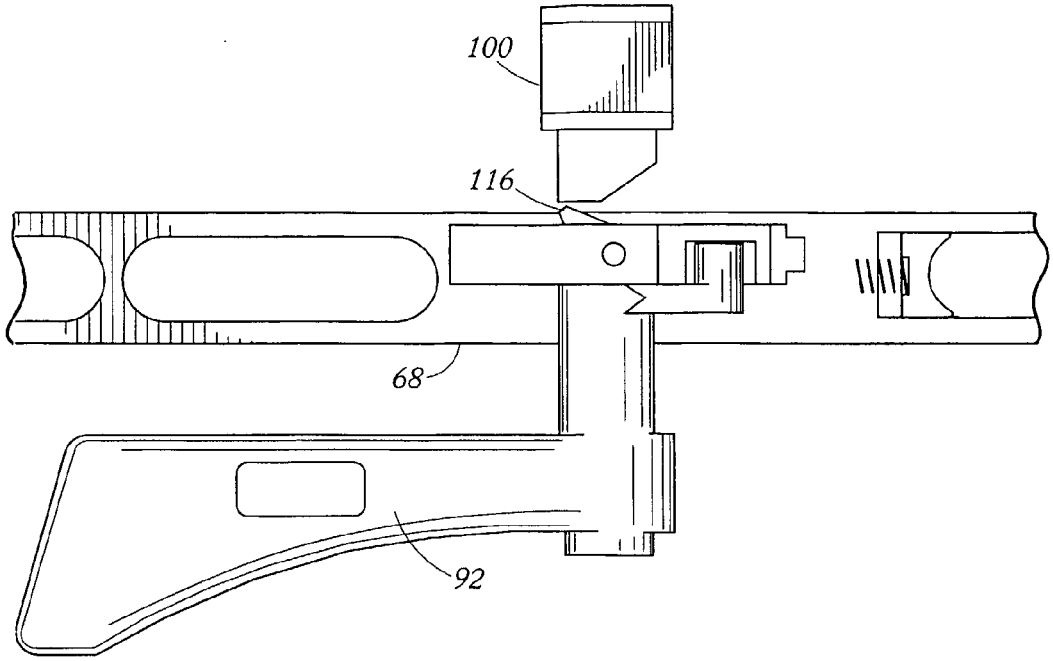
Figure 29:
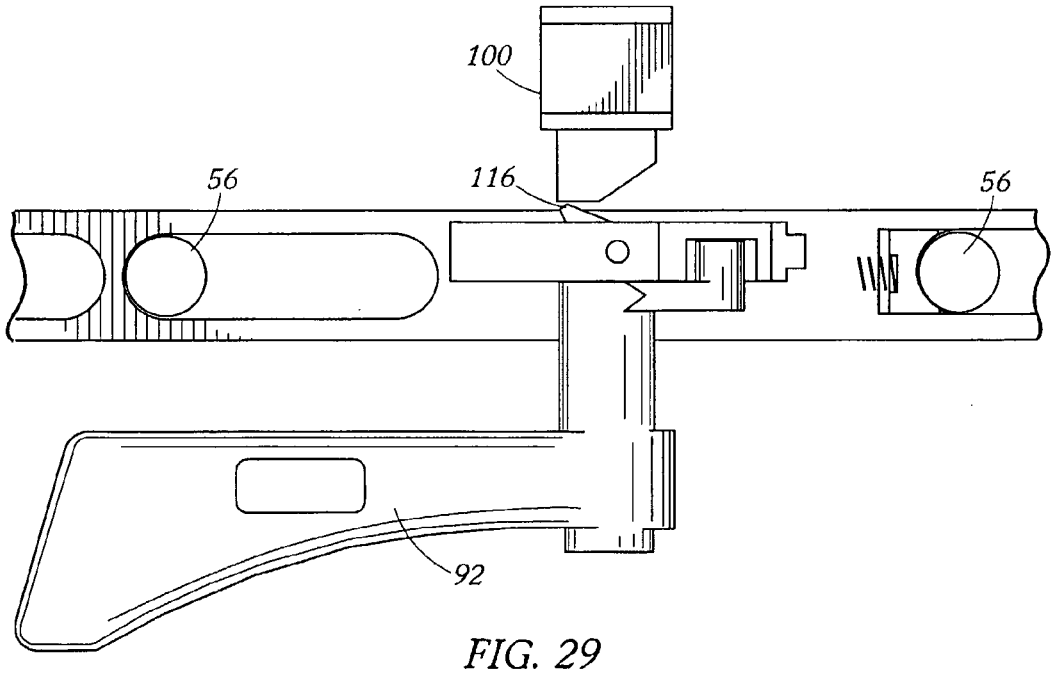
Figure 30:
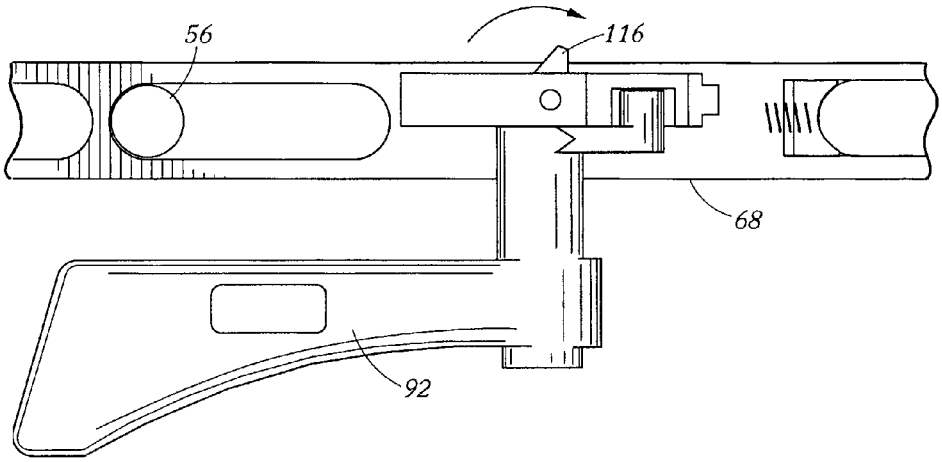

By reversing the closing process, the suitcase 2 is opened. Referring to FIG. 26, operative lever 92 is rotated by the user back toward the 0° position. As operative lever 92 and rack 68 cooperatively move, notice spring 104 begins to become compressed. Referring to FIGS. 26 and 27, as rack 68 moves to the right, detent trigger 100 pushes detent 116 out of the way. Looking to FIGS. 28 and 29, once operative lever 92 has become completely depressed into to the 0° position, the detent trigger 100 again becomes fully aligned with detent 116; however, the lid shell 6 has not yet been lifted. Turning to FIG. 30, upon lifting lid shell 6, the detent 116 pops back into its resting position, ready again to be rotated to start the process of moving the MPC 14 from the open stage, automatically to the pre-close stage, and finally to the secure stage.

The MPC 14 provides a reliable, easy to use, elegant method and system for ensuring proper latching of multiple latching mechanisms around the perimeter of a luggage case 2. The present invention comprises a low-friction, durable system that ensures safety of a user's belongings by providing an extra measurement of closure by drawing the two portions of the luggage case 2 even further together. The user enjoys a single operative mechanism 16, and needs to exert only a minimal amount of pressure to latch the case 2, thanks to the design of the operative lever 16. The user needs not worry about their suitcase 2 popping open due to a failed latching mechanism. Further, the multi-point closure system 14 provides an automated method and system for ensuring the successful engagement of the latching mechanisms.

Although the present invention has been described with a certain degree of particularity, it is understood that the present disclosure has been made by way of example, and changes in detail or structure may be made without departing from the spirit of the invention as defined in the appended claims.

What is claimed is:

1. A luggage latching mechanism comprising:

at least one male mating device operatively associated with a mating portion of a luggage case;

at least one female mating device operatively associated with a secondary mating portion of the luggage case; and said at least one male mating device and said at least one female mating device configured to allow each of said at least one female mating device to slide relative to a corresponding male mating device of said at least one male mating device and to draw said corresponding male mating device towards said secondary mating portion of the luggage case in order to provide said luggage latching mechanism with at least three stages of operation, comprising:

an open stage, said open stage providing disengagement of each of said at least one female mating device with its corresponding male mating device and allowing said luggage case to be opened by separating said mating portion from said secondary mating portion;

a pre-close stage, said pre-close stage providing an engagement of each of said at least one female mating device with its corresponding male mating device in such a manner that each of said at least one female mating device cannot be disengaged from its corresponding male mating device without first sliding each of said at least one female mating device relative to its corresponding male mating device and further providing for said mating portion and said secondary mating portion to be separated by a gap; and a secure stage, said secure stage providing engagement of said mating portion and said secondary mating portion of said luggage case by each of said at least one female mating device drawing its corresponding male mating device towards said secondary mating portion to eliminate the gap between said mating portion and said secondary mating portion and thus bring said mating portion into engagement with said secondary mating portion and further providing continued engagement of each of said at least one female mating device and its corresponding male mating device in such a manner that each of said at least one female mating device cannot be disengaged from its corresponding male mating device without first sliding each of said at least one female mating device relative to its corresponding male mating device.

2. The luggage latching mechanism of claim 1, further comprising a detent trigger mounted on a portion of said mating portion, the detent trigger configured to activate a detent that is mounted on a portion of said secondary mating portion and that positions each of said at least one female mating device into engagement with its corresponding male mating device.

3. The luggage latching mechanism of claim 1, further comprising a sliding device configured to slide each of said at least one female mating device relative to its corresponding male mating device.

4. The luggage latching mechanism of claim 3, wherein said sliding device is located within a frame of said luggage case that is associated with said secondary mating portion.

5. The luggage latching mechanism of claim 4, wherein said at least one female mating device is attached to said sliding device.

6. The luggage latching mechanism of claim 5, further comprising a handle system that is rotated to engage with said sliding device to slide each of said at least one female mating device relative to its corresponding male mating device.

7. The luggage latching mechanism of claim 6, further comprising a cam and cam follower system that draw said mating portion and said secondary mating portion into engagement upon entering said secure stage.

8. The luggage latching mechanism of claim 6, wherein the sliding device comprises a series of flexible links and rigid carriages, wherein said at least one female mating device includes a plurality of female mating devices, wherein each female mating device cooperates with a corresponding rigid carriage of the rigid carriages, each rigid carriage defining a cam follower, each of said female mating devices comprises a catch plate including cams that are operatively associated with the cam follower of the corresponding rigid carriage with which each said female mating device cooperates, said flexible links are in alignment with said rigid carriages, and said flexible links and said rigid carriages are configured for selective sliding movement relative to said frame to engage and disengage said mating portion and said secondary mating portion.

9. The luggage latching mechanism of claim 8, wherein a drive pinion gear located on an operative lever of said handle system corresponds with mating teeth located on said sliding device to facilitate movement of said flexible links and said rigid carriages.

10. The luggage latching mechanism of claim 8, wherein a bell crank located on an operative lever of said handle system engages with a cam device attached to said sliding device to facilitate movement of said flexible links and said rigid carriages.

11. The luggage latching mechanism of claim 10, wherein a detent that is located on said sliding device is configured to force said operative lever to a location that is past a dead center point of a cam located in said cam device.

12. The luggage latching mechanism of claim 11, wherein a detent trigger, located within a frame associated with said mating portion, is configured to rotate said detent thereby rotating the operative lever past said dead center point.

13. The luggage latching mechanism of claim 12, wherein a torsion spring positions said detent from a rotated position back to a resting position.

14. The luggage latching mechanism of claim 3, wherein the sliding device comprises a flexible link that is configured to move laterally within a frame associated with said secondary mating portion, said flexible link including knobs that provide stiffness to said flexible link, continuity and ease of motion of said flexible link, and repeatable accurate positioning of said flexible link.

15. The luggage latching mechanism of claim 1, wherein said luggage case includes a lid shell that includes said mating portion and a base shell that includes said secondary mating portion.

16. The luggage latching mechanism of claim 15, further comprising a detent trigger that is mounted on a portion of said lid shell and that activates a detent that is mounted on a portion of the base shell.

17. The luggage latching mechanism of claim 16, further comprising at least one rack, at least one carriage, and at least one flexible link that respond to activation of said detent to move said at least one male mating device and said at least one female mating device into the pre-close stage.

18. The luggage latching mechanism of claim 1, wherein said at least one male mating device comprises a hook and said at least one female mating device comprises a catch plate.

19. The luggage latching mechanism of claim 18, wherein said mating portion comprises a groove and said secondary mating portion comprises a corresponding protruding edge.

* * * * *

UNITED STATES PATENT AND TRADEMARK OFFICE

CERTIFICATE OF CORRECTION

PATENT NO. : 8,434,794 B2
APPLICATION NO. : 11/574448
DATED : May 7, 2013
INVENTOR(S) : Sijmons et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1608 days.

Signed and Sealed this
Eighth Day of September, 2015

Michelle K. Lee

Michelle K. Lee
*Director of the United States Patent and Trademark Office*